US010029763B2

(12) United States Patent
Taylor

(10) Patent No.: US 10,029,763 B2
(45) Date of Patent: Jul. 24, 2018

(54) CHAIN STOPPER

(71) Applicant: Flintstone Technology Limited, Dundee (GB)

(72) Inventor: Richard Taylor, Cumbria (GB)

(73) Assignee: Flintstone Technology Limited, Dundee (GB)

( * ) Notice: Subject to any disclaimer, the term of this patent is extended or adjusted under 35 U.S.C. 154(b) by 0 days.

(21) Appl. No.: 15/129,929

(22) PCT Filed: Mar. 30, 2015

(86) PCT No.: PCT/GB2015/050973
§ 371 (c)(1),
(2) Date: Sep. 28, 2016

(87) PCT Pub. No.: WO2015/150770
PCT Pub. Date: Oct. 8, 2015

(65) Prior Publication Data

US 2017/0174293 A1 Jun. 22, 2017

(30) Foreign Application Priority Data

Mar. 31, 2014 (GB) ..... 1405781.4

(51) Int. Cl.
*B63B 21/18* (2006.01)
*B63B 21/10* (2006.01)
(Continued)

(52) U.S. Cl.
CPC ..... *B63B 21/18* (2013.01); *B63B 21/04* (2013.01); *B63B 21/10* (2013.01); *B63B 21/20* (2013.01);
(Continued)

(58) Field of Classification Search
CPC ..... B63B 21/04; B63B 21/10; B63B 21/18; B63B 21/00; B63B 21/50; B63B 21/20
(Continued)

(56) References Cited

U.S. PATENT DOCUMENTS 4,958,805 A 9/1990 Williamsson
5,845,893 A * 12/1998 Groves ..... B63B 21/50 114/293
(Continued)

FOREIGN PATENT DOCUMENTS

EP 1 318 072 A2 6/2003
JP 62-241788 A 10/1987
WO WO 2010/085156 A1 7/2010

OTHER PUBLICATIONS

International Search Report and Written Opinion, PCT/GB2015/050973, dated Sep. 23, 2015, 14 pages.
(Continued)

*Primary Examiner* — Lars A Olson
(74) *Attorney, Agent, or Firm* — Myers Bigel, P.A.

(57) ABSTRACT

The invention relates to a device (60), such as a chain stopper, for connecting a chain 320 or at least one portion of a chain (320) to a structure (55), such as an offshore structure or vessel. The device comprising a first portion (70) pivotably or rotatably connected or connectable to a structure (55) so as to provide movement of the first portion (70) relative to a structure (55) about or around a first axis (310) of the first portion (70). The first portion comprises a chain or line guiding means (75) arranged for rotational movement about or around the first axis (310) of the first portion (70). In some examples, the device (70) may comprise a second portion (80) pivotably or rotatably connected or connectable to the first portion (70) so as to provide movement of the second portion (80) relative to the first portion (70) about or around a second axis (315) of the second portion. In some examples, the device may comprise at least one means for engaging (85) a chain 320, the engaging means (85) being connected,
(Continued)

such as pivotably or rotatably connected, to the second portion.

21 Claims, 11 Drawing Sheets

(51) Int. Cl.
*B63B 21/20* (2006.01)
*B63B 21/50* (2006.01)
*B63B 21/04* (2006.01)

(52) U.S. Cl.
CPC ..... *B63B 21/50* (2013.01); *B63B 2021/203* (2013.01); *B63B 2205/00* (2013.01)

(58) Field of Classification Search
USPC ..... 114/200, 230.2, 230.26
See application file for complete search history.

(56) References Cited

U.S. PATENT DOCUMENTS

| | | | | |
|---|---|---|---|---|
| 7,926,436 | B2 | 4/2011 | Boatman et al. | |
| 2005/0241558 | A1 | 11/2005 | Barlow | |
| 2012/0160146 | A1* | 6/2012 | Miller | B63B 21/10 114/200 |

OTHER PUBLICATIONS

Patents Act 1977: Search Report under Section 17(5), UKIPO Application No. GB1405781.4, dated Nov. 13, 2014, 3 pp.

* cited by examiner

Mooring chain is clear of articulation linkages during pull-in of the mooring line.

CHAIN STOPPER

RELATED APPLICATIONS

This application is a 35 U.S.C. § 371 national stage application of PCT Application No. PCT/GB2015/050973, filed on Mar. 30, 2015, which claims priority from Great Britain Patent Application No. 1405781.4 filed on Mar. 31, 2014, the contents of which are incorporated herein by reference in their entireties. The above-referenced PCT International Application was published in the English language as International Publication No. WO 2015/150770 A1 on Oct. 8, 2015.

FIELD OF INVENTION

This invention relates to a device, an apparatus, a system and an associated method(s). In particular, but not exclusively, embodiments of the invention relate to specific device, apparatus, system and method(s). The device may be a so-called "chain stopper." The device may find utility in or on a structure, such as a marine structure, offshore structure, subsea structure, floating structure, floating platform, buoy or vessel.

BACKGROUND TO INVENTION

Chain stopper devices can provide an attachment or connection of a chain to, for example, a vessel, which may be moored to a seabed. By adjustment of a chain length or tension of a chain connected to the vessel or a position of the vessel can be altered or controlled.

Adjusting and/or pulling of the chain can lead to fatigue and wear of the chain due to chafing and out of plane bending at the attachment or connection region of the chain to the vessel. For example, upward pulling-in of the chain may cause the chain having to manoeuver or bend around small or tight corners with small radii as in U.S. Pat. No. 7,926,436 (SOFEC). This may cause fatigue and wear of the chain and compromise the lifetime of a chain by years.

Guiding of a chain around small corners may also limit the loads, tension or pre-tension, which may be applied to the chain during installation.

U.S. Pat. No. 7,926,436 (SOFEC) discloses a chain support, hinged on two perpendicular axes which allows chain movement in two perpendicular planes. The chain support allows chain to be pulled through the centre of the apparatus to a desired length after which the chain is removable secured to the chain support.

A self-weight of a chain and/or tensioning or pulling of a chain may cause loads in an axial direction, e.g. in a direction along a longitudinal axis, of a vessel. This may results in large and heavy chain stoppers, which may be difficult to fabricate. Also the fabrication of large and heavy chain stopper can be very costly and time intensive.

It is an object of at least one embodiment of at least one aspect of the present invention to seek to obviate or at least mitigate one or more of the aforementioned problems in the prior art.

It is a further object of at least one embodiment of at least one aspect of the present invention to seek to obviate or at least mitigate one or more problems in the prior art.

SUMMARY OF INVENTION

According to a first aspect of the present invention there is provided a device, such as a chain stopper, for connecting a chain or line or at least one portion of a chain or line, such as a mooring, tethering, anchoring chain or line or the like, to a structure, such as an offshore structure or vessel, the device comprising:

a first portion pivotably or rotatably connected or connectable to a structure so as to provide movement of the first portion relative to a structure about or around a first axis of the first portion; wherein the first portion comprises a chain or line guiding means arranged for rotational movement about or around the first axis of the first portion.

The chain guiding means may be arranged on or in the first portion.

The device may comprise a second portion. The second portion may be pivotably or rotatably connected or connectable to the first portion so as to provide movement of the second portion relative to the first portion, e.g. about or around a second axis of the second portion and/or first portion.

The device may comprise at least one means for engaging a chain or line. The engaging means may be comprised in or part of the second portion. The at least one engaging means may be connected or connectable to, arranged and/or arrangeable on or in the device and/or the second portion the device.

The engaging means may be pivotably or rotatably connected or connectable to, arranged and/or arrangeable on or in the second portion (and/or the device) to allow movement, such as rotational or pivotal movement, of the engaging means relative to the first portion, second portion and/or the device. By allowing rotational or pivotal movement of the engaging means relative to the first portion, second portion and/or device, adjusting of a length and/or tensioning of a chain may be simplified.

The engaging means may be connected to and/or arranged on or in the second portion (and/or the device) so as to be rotatable or pivotal around or about a third axis of the engaging means, the second portion and/or the device.

The degree or range of the rotational or pivotal movement of the engaging means, e.g. about or around the third axis, may be limited or restricted. The engaging means may be configured for receiving a chain. For example, a chain may be pulled through, threaded through and or directed through the engaging means. The engaging means may be configured to restrict or prevent movement of the chain or line in at least one direction, e.g. in use.

The first axis may be oriented substantially perpendicular to the second axis or vice versa.

The device may be suitable for adjusting a length and/or tension of a chain or line relative to a structure.

The device may be configured to connect, or attach, e.g. releasably connect or attach, a chain or line or a portion or end thereof to a structure. For example, the device may be configured to connect or attach a proximal portion or end of a chain to a structure. The proximal end or portion of a chain may be or comprise an end or portion of a chain that may be proximal to, connectable or connected to a structure. The chain may comprise a distal end or portion. The distal end or portion may be or comprise an end or portion of a chain that may extend towards a seabed and/or may be moored, anchored or secured to a seabed.

The first axis may comprise a substantially transverse first axis. The first axis may be perpendicular to a longitudinal axis or central axis of the first portion and/or device.

The second axis may be a substantially transverse second axis. The second axis may be perpendicular to the longitudinal axis or central axis of the first portion, second portion and/or device.

The first axis and/or third axis may be considered as extending in an x-direction. The second axis may be considered as extending in a y-direction. The longitudinal axis may be considered as extending in a z-direction.

The chain guiding means may be pivotably or rotatably arranged on or in the first portion for movement, such as rotational moment, about or around the first axis of the first portion.

The second portion may be configured to be pivotably or rotatably connected or connectable to the first portion so as to provide rotational movement of the second portion relative to the first portion about or around a second axis of the second portion.

The second portion may comprise or define a passage through which a chain or a portion thereof, e.g. the proximal end or portion of a chain, may be run, threaded and/or pulled. The passage may be partially open so that a chain or portion thereof, e.g. the proximal end or portion of a chain, contained therein may be visible. By providing a partially open passage, a chain may be visible, which may simplify inspection of a chain.

The second portion may comprise a first and/or a second opening for receiving a chain. A chain may exit or enter the second portion at the first opening, which may be arranged at or on the second portion, such as at a proximal end of the second portion. Alternatively or additionally a chain may exit or enter the second portion at the second opening, which may be arranged at or on the second portion, such as at a distal end of the second portion.

The means for engaging of a chain may be arranged at the distal end of the second portion. The engaging means may define or comprise the second opening of the second portion.

In use, adjusting a length of a chain and/or tensioning of a chain or line may be achieved by pulling, such as pulling-in, pulling substantially upwards and/or pulling towards a structure, or letting out or releasing of a chain.

The engaging means may be rotatable or pivotal relative to the second portion and/or device between a first position or configuration and a second position or configuration. In use, when tension acts on or is applied to the proximal end or portion of a chain, e.g. by pulling-in of a chain, and/or the distal portion or end of a chain, e.g. due to a chain being moored, anchored and/or connected to a seabed, the engaging means be may actuated or operated from the first position to the second position, or vice versa. In other words, in use, when tension is applied to or acts on the proximal end or portion and/or distal end or region of a chain, the engaging member may rotate or pivot about the third axis from the first position to the second position, or vice versa.

For example, the engaging means may be in the first position, when no tension is applied to the proximal portion or end of a chain, e.g. in use. In the first position of the engaging means, the distal end or portion of a chain may enter or exist the second opening at an angle relative to the central axis. In the first position of the engaging means, e.g. when no tension is applied to the proximal portion or end of a chain, the proximal end or portion of a chain may be in line or coaxially arranged to the distal end or portion of a chain.

For example, when tension is applied to the proximal end or portion of a chain, for example by pulling-in of a chain, the engaging means may rotate or pivot into the second position, e.g. in use. In the second position of the engaging means, the distal end or portion of a chain may be coincident, in line with or coaxially arranged to the central axis of the first portion, second portion and/or device, e.g. in use. By providing a coaxial arrangement between the central axis of the device, first and/or second portion relative to the distal portion or end of a chain, e.g. when tension is applied to the proximal end or portion of a chain, out of the plane (axis) bending or strain of a chain may be prevented or eliminated. The coaxial arrangement may also allow the use higher forces during pulling-in of a chain.

The connection between the engaging means and the second portion and/or device may be configured to limit or restrict the range of rotational movement of the engaging means relative to the second portion and/or device.

The engaging means may be pivotably or rotatably connected or connectable to the second portion at a first connection point or region of the second portion. The engaging means may be slideably connected or connectable to the second portion at a second point or region of the second portion. The connection between the engaging means and the second portion and/or the device may be configured to simultaneously provide pivotal and slideable movement of the engaging means about the third axis. The first point or region may be arranged opposite, e.g. width wise opposite, the second point or region.

The device may comprise an elongate member. The elongate member may be or comprise a further pin or bolt or the like. The elongate member may provide a pivotal connection between the engaging means and the second portion at the first point or region of the second portion. The further elongate member may provide or define the third axis of the engaging means.

The device may comprise a yet further elongate member. The yet further elongate member may be or comprise a yet further pin or bolt or the like. The yet further elongate member may extend through at least one elongated slot, e.g. a pair of elongated slots, which may be provided in the second portion, thereby slidably connecting the engaging means to the second point or region of the second portion. In the first position of the engaging means, the yet further elongate member may be in engagement with or abut a first end of the elongated slot, e.g. in use. In the second position of the engaging means, the yet further elongate member may be in engagement with or abut a second end of the elongated slot, e.g. in use.

A chain (or portion thereof) may comprise a tensioned portion and/or a less tensioned or slack portion, e.g. in use.

The proximal end or portion may be slack or loose and/or comprise a slack, less tensioned or loose portion, e.g. in use, when no tension is applied to the proximal end or portion of the chain.

The distal end or portion may be tensioned and/or comprise a tensioned portion, e.g. in use, when no tension and/or no tension is applied to the proximal end or portion of the chain.

For example, in use, a chain (or portion thereof) exiting or entering the device, e.g. the first opening of the second portion, may be slack or loose, e.g. when no tension is applied to the proximal end or portion of the chain. Alternatively or additionally, a chain entering the device, e.g. the second opening of the second portion, may be tensed or be under tension, in use, e.g. when no tension and/or tension is applied to the proximal end or portion of the chain.

For example, a chain (or portion thereof) exiting or entering the second opening may be, define or comprise the tensioned portion of a chain, e.g. in use, for example, when no tension and/or tension is applied to the proximal end or portion of a chain. The distal portion or end of a chain may be or comprise the tensioned portion of a chain.

For example, a chain (or portion thereof) exiting or entering the device, e.g. the first and/or second opening, may be, define or comprise the less tensioned or slack portion, e.g. in use, for example, when no tension is applied to the proximal end or portion of a chain.

The device (e.g. the first portion and/or the chain guiding means) may be configured so that, e.g. in use, a chain or a portion thereof, e.g. the proximal end or portion of a chain, may be disposed or arranged to pass below or under the first axis, second axis and/or the chain guiding means.

For example, the device (e.g. the first portion and/or the chain guiding means) may be configured so that, the proximal end or portion of a chain, e.g. the less tensioned or slack portion, may be disposed or arranged so as to pass below or under the first axis, second axis and/or the chain guiding means. The device (e.g. the first portion and/or the chain guiding means) may be configured so that the proximal end or portion of a chain, e.g. the less tensioned or slack portion, may pass below or under the first axis, second axis and/or chain guiding means so as to provide a clearance and/or space between a chain and first and/or second axis and/or first portion. Alternatively or additionally, the proximal end or portion of a chain, e.g. the less tensioned or slack portion, may pass behind the first axis, second axis and/or chain guiding means so as to provide a clearance and/or space between a chain and first and/or second axis and/or first portion. For example, the proximal end or portion of a chain, e.g. the less tensioned or slack portion, may pass in between, e.g. a space defined, created or present between, the chain guiding means and/or first axis and a structure. By passing proximal end or portion of a chain, e.g. the less tensioned or slack portion, below or under the first axis and/or chain guiding means to provide a clearance and/or space between a chain and first and/or second axis, catching of a chain or a portion thereof on the first and/or second axis may be prevented, e.g. in use.

The chain guiding means may be configured to guide a chain or a portion of a chain, e.g. the proximal portion or end of a chain, about the first axis offset or at distance from the first axis. The offset or distance may be defined between the first axis and a chain engagement portion or point of the chain guiding means, e.g. a portion of the chain guiding means, which may be in contact with a chain.

The device, e.g. the chain guiding means and/or the first portion, is configured so that the proximal portion or end of a chain, e.g. the less tensioned or slack portion, may be disposed or extends at an acute angle to the longitudinal or central axis of the device, in use. For example, the proximal portion or end of a chain, e.g. the less tension or slack portion, may exit or enter the second portion at an acute angle to the longitudinal axis or central axis of the device. In other words, the proximal portion or end of a chain may extend tangentially relative to the chain guiding means and/or at an acute angle relative to the central axis of the device, e.g. in use. The acute angle may be defined by the offset or distance and a further distance. The further distance may be a distance or length between the chain engagement portion of the chain guiding means and engaging means and/or second opening.

The first axis may be offset or spaced, e.g. offset or spaced along a/the longitudinal direction and/or central axis of the device, from the second axis or vice versa. For example, the first axis may be provided at an end of the first portion proximal to a structure. The second axis may be provided at the distal end of the first portion and/or at an end of the second proximal to the first portion. Alternatively, the first and second axes may coincide.

The first axis may define or comprise a (e.g. substantially) horizontal axis. In other words, the first axis may lie or extend in a horizontal plane, e.g. a substantially horizontal plane. By providing movement of the first portion about or around the (e.g. substantially) horizontal axis of the first portion, fabrication the device and/or attachment of the device and/or first portion to a structure may be simplified and/or weight of the device may be reduced.

The first axis may allow movement, such as rotational movement, of the first portion relative to a structure comprising at least one first degree of freedom.

The second axis may allow movement, such as rotational movement, of the second portion relative to the first portion and/or an offshore structure comprising at least one second degree of freedom.

The at least one first degree of freedom may be substantially perpendicular to the at least second degree of freedom.

The first and second portions of the device and/or the first and second axes may allow movement, e.g. rotational movement, of a chain relative to a structure comprising two or more degrees of freedom. By providing the device with a first and/or second axis, movement, e.g. rotational movement, of a chain relative to a structure may comprise two or more degrees of freedom. The first and second portions of the device and/or the first and second axes may allow movement, e.g. rotational movement, of a chain relative to a structure in two or more directions and/or planes. In some examples, the at least two of the two or more directions and/or planes may be substantially perpendicular to another.

The first portion may be attached, connected, attachable or connectable to a structure via a first connection means. For example, a proximal end of the first portion may be attached, connected, attachable or connectable to a structure via the first connection means. The first connection mean may define or comprise the first axis. The first connection means may provide rotational movement of the first portion about or around the first axis. The first connection means may provide a connection, linkage or joint, which may comprise at least one first degree of freedom.

The second portion may be attached, connected, attachable or connectable to the first portion via a second connection means. For example, the proximal end of the second portion may be attached, connected, attachable or connectable to a distal end of the first portion via the second connection means. The first and/or second connection means may define or comprise the second axis. The second connection means may provide rotational movement of the second portion about or around the second axis. The second connection means may provide a further connection, linkage or joint, which may comprise at least one second degree of freedom.

The first and/or second connection means may allow or may be configured to provide rotational movement of a chain about or around the first and/or second axis (axes) of the first and/or second portion relative a structure. The first and/or second connection means may be configured to provide movement, e.g. rotational movement, of a chain in two or more planes and/or directions relative to a structure. By providing rotational movement of a chain or line in two or more planes and/or direction, bending stresses, such as out of plane bending stresses, in a chain may be minimised or prevented.

The first connection means may comprise at least one first pin, protrusion or bolt or the like.

The first connection means may comprise at least one first aperture. the first connection means may comprise at least one first and/or second apertures. The first and/or second apertures may be carried by or provided on the end, such as the proximal end, of the first portion for attachment to a structure. The at least one first and/or second apertures may be opposite or and/or opposed to one another.

A structure may comprise at least one first and/or second attachment means, which may extend or protrude from a structure. The first connection means may be configured for connection to a/the first and/or second attachment means of a structure. The at least one first and/or second attachment means may be substantially vertically arranged or oriented relative to a structure. The first and/or second attachment means may comprise one or more bracket(s).

The at least one first and/or second attachment means may comprise at least one first and/or second further apertures, respectively. In use, the at least one first and/or second apertures of the first portion may be aligned with the at least one first and/or second further apertures of the first and/or second attachment means. When aligned the at least one first pin may be inserted and/or extend through the first and/or second apertures of the first portion and the first and/or second further aperture, thereby connecting the first portion to a structure. The first and/or second apertures of the first portion and/or the first and/or second further apertures of the first and/or second attachment may be arranged or oriented substantially vertically, e.g. in a substantially vertical plane and/or direction, relative to a structure. By vertically orienting the first and second apertures and/or the first and second further apertures, axial or thrust loads, which may act on a structure and/or the device, may be reduced.

The second connection means may comprise one or more aperture(s). At least one third aperture may be carried by or provided on the end, such as the distal end, of the first portion. The second connection means may comprise at least one fourth and/or fifth aperture carried on or provided by the end, such as the proximal end, of the second portion.

The second connection means may comprise at least one second pin, protrusion or bolt, which may be inserted and/or extend through the third, fourth and/or fifth apertures, thereby connecting the second portion to the first portion.

The first and/or second connection means may define or comprise a connection arrangement, such as uni-joint or extended uni-joint arrangement.

The first and/or second connection means may define or comprise at least one first bearing and/or second bearing, e.g. at least one first low friction bearing and/or second low friction bearing, such as an Orkot bearing or non-metallic bearing.

The first and/or second transverse axis (axes) may be provided by one or more pin(s) or protrusion(s), which may act as one or more bearing shaft(s).

The chain guiding means and the first portion, e.g. the first axis, may be coaxially arranged. The chain guiding means may be arranged to guide a chain around the first transverse axis. By coaxially arranging the chain guiding means and the first portion, e.g. the first transverse axis, loads and/or moments caused by, e.g. pulling or tensioning of a chain, and which may act on the device, may be reduced. The coaxial arrangement of the chain guiding means and the first portion, e.g. the first transverse axis may reduce or prevent movement of a chain and/or device, e.g. first and/or second portions, in a substantially vertical plane and/or direction.

The chain guiding means may be configured and/or arranged to facilitate tensioning, pulling (pulling-in) and/or letting out of a chain, e.g. for adjusting a length of chain, tension of a chain and/or changing the position of a structure, e.g. in use. In some examples, the chain guiding means may be or comprise a guide wheel, such as a fairlead wheel, sheave or cog wheel or the like. A radius of the guide wheel may define the offset or distance between a chain engagement portion or point and the first axis. The guide wheel may comprise or define one or more pockets, cogs or protrusions for engaging with a chain. For example the guide wheel may comprise or define five pockets, cogs or protrusions. In other examples, the wheel may comprise more or less than five pockets or cogs, e.g. three or seven pockets or cogs. Alternatively or additionally, the chain guiding means may comprise or define a bending shoe.

The engaging means may define or comprise means for adjusting of a length and/or tension of a chain connected or attached to a structure. Alternatively or additionally, a position, such as a position, of a structure may be altered and/or controlled by adjusting a length and/or tension of a chain or line with respect to seabed and/or a structure.

The engaging means may be configured to inhibit movement, e.g. movement in the longitudinal or axial direction of a chain and/or the device. For example, the engaging means may be configured to restrain and/or lock any movement of a chain in a first direction relative to a structure, e.g. movement of a chain in a longitudinal direction of the device towards a seabed. Alternatively or additionally, the engaging means may be configured to allow movement of a chain in a second direction relative to a structure, e.g. movement of a chain in the longitudinal direction of the device towards a structure.

The engaging means may be arranged to in line or aligned with the longitudinal axis of the first, second portion and/or device. In other words, a central axis of the engaging means may be arranged coaxially to the central axis of the device. In use, the alignment of the engaging means along the longitudinal axis of the first, second portion and/or device may reduce or prevent out-of plane bending stresses, which may act on the chain.

The engaging means may comprise an engaged and/or a disengaged configuration or position. In the engaged configuration, the engaging means may inhibit movement of a chain in one or more directions, such as one or more axial and/or longitudinal directions with respect to the first portion, second portion and/or device. For example, in the engaged configuration the engaging means may restrain and/or lock (axial and/or longitudinal) movement of a chain in the first direction (e.g. towards a seabed) relative to the first portion, second portion and/or device.

In the disengaged configuration, the engaging means may allow movement of a chain in one or more directions. For example, movement of a chain may be possible in the first and/or second direction (e.g. towards a structure and/or seabed). The engaging means may define or act as a ratchet, e.g. a one-way ratchet. By providing the second portion with a ratchet, a length of a chain and/or tension of a chain may be adjusted and/or controlled. Alternatively or additionally, a position, such as an offshore position, of a structure may be altered and/or controlled by adjusting a length and/or tension of a chain.

Tensioning or pulling, e.g. pulling-in or pulling substantially vertically upwards, of a chain in the second direction (e.g. towards a structure) may actuate the engaging means from the engaged configuration into the disengaged configuration. Pulling, strain and/or tension acting in the first direction (e.g. towards a seabed) may actuate the engaging means from the disengaged configuration into the engaged configuration. Alternatively or additionally, the engaging means and/or device may be actuated or actuateable, such as hydraulically or electrically actuated or actuateable, from the engaged configuration to the disengaged configuration, or vice versa. For example, a winch means and/or control means may be provided, providable, locatable or located on a structure. The winch means may be communicable or in communication with the engaging means and/or device. The winch means and/or control means may actuate, hydraulically or electrically actuate, the engaging means from the engaged to the disengaged configuration, or vice versa.

The control means may be located on a structure or an onshore site. The control means may be a controlling station, room or the like.

The engaging means and/or device may be connected or connectable via a cable, line, hydraulic and/or electrical line, umbilical or the like, to the winch means and/or control means so as to allow actuation of the engaging means. In other examples, the engaging means and/or device may comprise an actuating means for actuating or operating the engaging means from the engaged configuration to the disengaged configuration, or vice versa. The actuating means may be a cylinder, piston or the like, e.g. a hydraulic cylinder or piston. The actuating means may be integral with the device and/or the engaging means.

In use, a chain may be releasable, let out or released by actuating or operating the engaging means from the engaged configuration to the disengaged configuration, e.g. by pulling of a chain in the second direction or using the actuating means, and maintaining the engaging means in the disengaged configuration while a chain may be let out or released.

In use, a chain may be removed removable, maintained, maintainable, exchangeable and/or exchanged from the engaging means by actuating or operating the engaging means into the disengaged using, for example a Remotely Operated Vehicle (ROV). A ROV may be used for actuating or operating the engaging means from the engaged to the disengaged configuration, or vice versa.

The engaging means may comprise or define a stopper member mounted, e.g. pivotally mounted, so as to be actuable between the engaged and disengaged configuration of the engaging means. The stopper member may be connected or fixed to the engaging means via a hinged arrangement. The hinged arrangement may comprise a resilient member, such as a spring, which may actuate the stopper member in either the engaged or disengaged configuration. In the engaged configuration the stopper member may partially occlude the passage of the second portion. The stopper member may comprise a slot or recess for engaging with a chain or one or more chain links of a chain so as to prohibit movement of a chain in the first direction. The slot or recess of the stopper member may be arranged so as to provide a resolution of one or more chain links, e.g. a single and/or dual chain link resolution. For example, the slot may be configured to allow passage of one or more chain links of a chain, which may be in alignment with the slot. The slot may be configured to prevent passage of one or more chain links, which may be in misalignment with the slot. One or more aligned chain links may be in a substantially parallel orientation relative to the slot. One or more misaligned chain links may be in a substantially perpendicular orientation relative to the slot. A chain may comprise a plurality and/or sequence of chain links, which may be in alignment or misalignment with the slot. The resolution of the stopper member may be controlled or controllable by the shape of the slot or recess. For example, the shape of the slot may be configured to complement or match a shape or profile of one or more aligned chain links to allow passage of one or more chain link. In some examples, the slot may comprise or define a shape, such as a U-shape or the like.

Alternatively or additionally, the stopper member may comprise a seat or support member that may be arranged on an edge or periphery of the slot or recess. In some example, the seat, support or guide may be spherical. In other example, the seat, support or guide may be oval, elliptical or the like.

One or more misaligned chain links or an end thereof may be supported or supportable by or rest against the seat or support member, e.g. in use. The shape of the seat or support member may be configured to match or complement a shape or profile of one or more misaligned chain links.

In some examples, the device may comprise one or more engaging means. The one or more engaging means may be part of or comprised in the second portion. By providing the device, e.g. the chain stopper, with one or more engaging means, such as two engaging means, single chain link resolution may be achieved. The one or more engaging means may be pivotably or rotatably, connected to, connectable to, mounted or arranged on or in the second portion. The one or more engaging means may be aligned along a longitudinal axis of the second portion. The one or more engaging means may be spaced from another along the longitudinal axis of the second portion. Alternatively or additionally, the one or more engaging means may be arranged adjacent to another along the longitudinal axis of the second portion.

The device may comprise at least one guiding portion. The guiding portion may be part of or comprised in the engaging means. The guiding portion may be configured to provide leverage to pivot or rotate the engaging means relative to the second portion and/or device. The guiding portion may be configured to maintain and/or cause an orientation or alignment of a chain while being run, threaded and/or pulled through the engaging means, second portion and/or the device. The guiding portion may comprises a first guiding aperture or opening, which may be positioned or located on a first end of the guiding portion, engaging means and/or the device. The guiding portion may comprise a second guiding aperture or opening, which may be positioned or located on a second end of the guiding portion. The guiding apertures may receive or guide a chain through the engaging means. The first guiding aperture may be arranged opposite of the second guiding aperture. The first and second guiding apertures may comprise or define a shape or profile for ensuring the orientation of a chain. For example, the first and second guiding apertures may comprise or define a cruciform, clover leaf shape or the like.

A structure may be or comprise an offshore structure, marine structure, subsea structure, floating structure, floating platform, buoy or vessel or the like. A structure may comprise a chain table or the like, which may be rotatably connected to a structure, e.g. to allow a structure to move or rotate relative to a chain table. In some examples, a structure may be a vessel. A vessel may comprise the chain table or the like, which may be rotatably connected to a vessel, e.g. to allow a vessel to move or rotate relative to a chain table.

A chain may comprise or be comprised of a plurality of chain links.

In some examples, the device may find utility with a line, wire, rope or the like, instead of a chain.

According to a second aspect of the present invention there is provided an apparatus or a system for connecting a chain or line or at least one portion of a chain or line to a structure, such as an offshore structure, the apparatus or system comprising:

at least one device for connecting a chain to a structure according to a first aspect of the present invention; and a structure.

One or more devices may be provided for connecting a chain or one or more chains to a structure.

The structure may be or comprise an offshore structure, marine structure, subsea structure, floating structure, floating platform, buoy or vessel or the like.

The apparatus or system may comprise a chain, such as a mooring, tethering or anchoring chain. A distal end or portion of the chain may be moored or anchored to a seabed. A proximal end or portion of a chain may be connected or connectable to the structure, for example, by the device. The chain may comprise or be comprised of a plurality of chain links. The chain may be a line, wire, rope or the like.

The apparatus or system may provide means for adjusting a length and/or tension of a chain relative to the structure.

In some examples, the structure may comprise a chain table or the like, which may be rotatably connected to the structure, e.g. a remainder of the structure, e.g. to allow the structure to move or rotate relative to a chain table.

In some examples, the structure may be or comprise a vessel. The vessel may comprise the chain table or the like, which may be rotatably connected to the vessel, e.g. to allow the vessel to move or rotate relative to the chain table.

The structure and/or chain may comprise any of the features and/or properties of the structure and/or chain defined in the first aspect.

According to a third aspect of the present invention there is provided a method for adjusting a length and/or tension of a chain, the method comprising:

providing a device in accordance with the first aspect of the invention;

adjusting and/or pulling, such pulling-in, pulling towards a structure or pulling substantially vertically upwards, of a chain or a portion thereof to a desired or pre-determined length and/or tension.

The method may comprise pulling of a chain (or a portion thereof, e.g. a proximal end or portion of a chain) in a first direction, such as substantially vertically upwards or towards a structure.

The method may comprise prohibiting movement of a chain, such as movement in an axial or longitudinal direction of a chain.

The method may comprise inspecting of a chain, e.g. inspecting a chain for damage or signs of fatigue.

The method may comprise removing a chain from the apparatus. Removing of a chain from the apparatus may be achieved by actuating the engaging member in the disengaged position.

According to a fourth aspect of the present invention there is provided a method for mooring, tethering or anchoring a structure, such as a vessel, relative to a seabed, the method comprising:

providing a device in accordance with the first aspect of the present invention; and running or threading a chain or a portion thereof through the device.

The method may comprise connecting a chain or a portion thereof to a structure, e.g. by using the device.

A distal portion of a chain may be moored or anchored to a seabed.

The method may comprise using the device to adjust a length and/or tension of a chain.

The method may comprise changing a position of a structure, by adjusting a length and/or tension of a chain.

According to a fifth aspect there is provided a structure, such an offshore structure, marine structure, subsea structure, floating structure, floating platform, buoy or vessel or the like, configured, adapted or arranged for connection of one or more device(s), such as one or more chain stopper(s), according to the first aspect of the present invention.

The structure may comprise at least one first and/or second attachment means. The at least one first and/or second attachment means may extend or protrude from the structure. The at least one first and/or second attachment means may be substantially vertically arranged or oriented relative to the structure. The at least one first and/or second attachment means may comprise one or more bracket(s).

The at least one first and/or second attachment means may be configured for connecting the device to the structure. For example, the at least first and/second attachment means may comprise one or more aperture(s), which may be substantially vertically oriented.

At least one first pin or protrusion may extend or be inserted through the one or more aperture(s), thereby connecting the device to the structure. The pin may provide or define a substantially horizontal axis, such as a substantially horizontal transverse axis. Preferably, the pin may be or define the first transverse axis of the device.

The structure may comprise a winch means. The winch means may be configured for pulling, pulling-in or letting out of a chain, thereby adjusting or controlling a length of a chain and/or tension of a chain. The winch means may be in communication with the device so as to allow pulling-in or letting-out of a chain or a portion thereof. The winch means may actuate, such as hydraulically or electrically actuate, the device to allow pulling-in or letting-out of a chain or a portion thereof.

The structure may comprise any features and/or properties of the structure defined in the first and/or second aspect.

It should be understood that the features defined above in accordance with any aspect of the present invention or below in relation to any specific embodiment of the invention may be utilised, either alone or in combination with any other defined feature, in any other aspect or embodiment of the invention.

BRIEF DESCRIPTION OF DRAWINGS

These and other aspects of the present invention will now be described, by way of example only, with reference to the accompanying drawings, which are:

FIG. 5 (*b*) an enlarged representation of an end of the chain stopper of FIG. 5 (*b*);

FIG. 7 (*b*) a top view of the chain stopper of FIG. 5 (*a*);

FIG. 9 (*b*) a further perspective view of the connection arrangement of FIG. 9(*a*);

FIG. 10 (*b*) a front view of the engagement means of FIG. 10 (*a*) in an engaged configuration;

FIG. 10 (*c*) a perspective view of the engagement means of FIG. 10 (*a*) in a disengaged configuration;

FIG. 10 (*d*) a perspective view of a stopper member of the engagement means of FIG. 10 (*b*);

FIG. 11 (*b*) a further perspective view of the guiding portion of FIG. 11 (*a*);

FIG. 11 (*c*) a further perspective view of the guiding portion of FIG. 11 (*a*) showing a first and second guiding aperture; and FIG. 11 (*d*) a top view of the guiding portion of FIG. 11 (*a*).

DETAILED DESCRIPTION OF DRAWINGS

Figure 1:
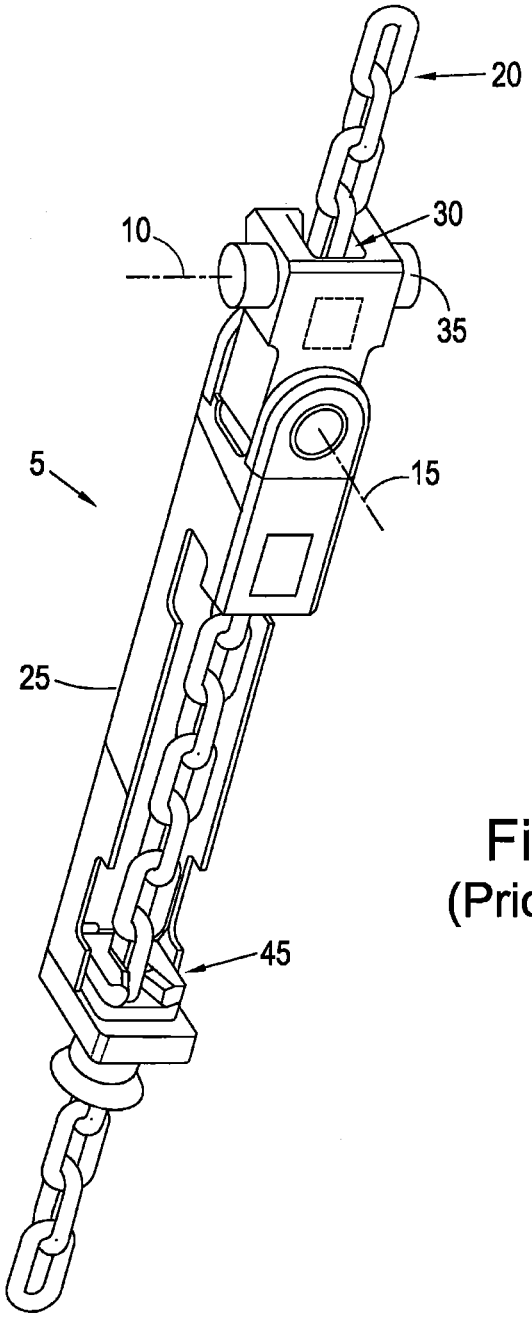
Fig.1 (Prior Art)
FIG. 1 an isometric representation of a chain stopper according to the prior art.

Referring to FIG. 1, there is shown a first embodiment of a device, such as a chain stopper 5 according to the prior art. The chain stopper 5 comprises two axes of rotation 10, 15. The chain stopper 5 allows rotation of the chain around a generally horizontal first axis 10 and a generally vertical second axis 15.

The chain 20 is pulled through an elongated hollow housing 25. The chain 20 exits the chain stopper through an opening 30 of the housing. The chain stopper 5 comprises a pair of trunnions 35, which connect the chain stopper 5 to table 40 (not shown in FIG. 1). The chain stopper 5 further comprises an engaging means 45 for adjusting a length and/or tension of the chain 20.

Figure 2:
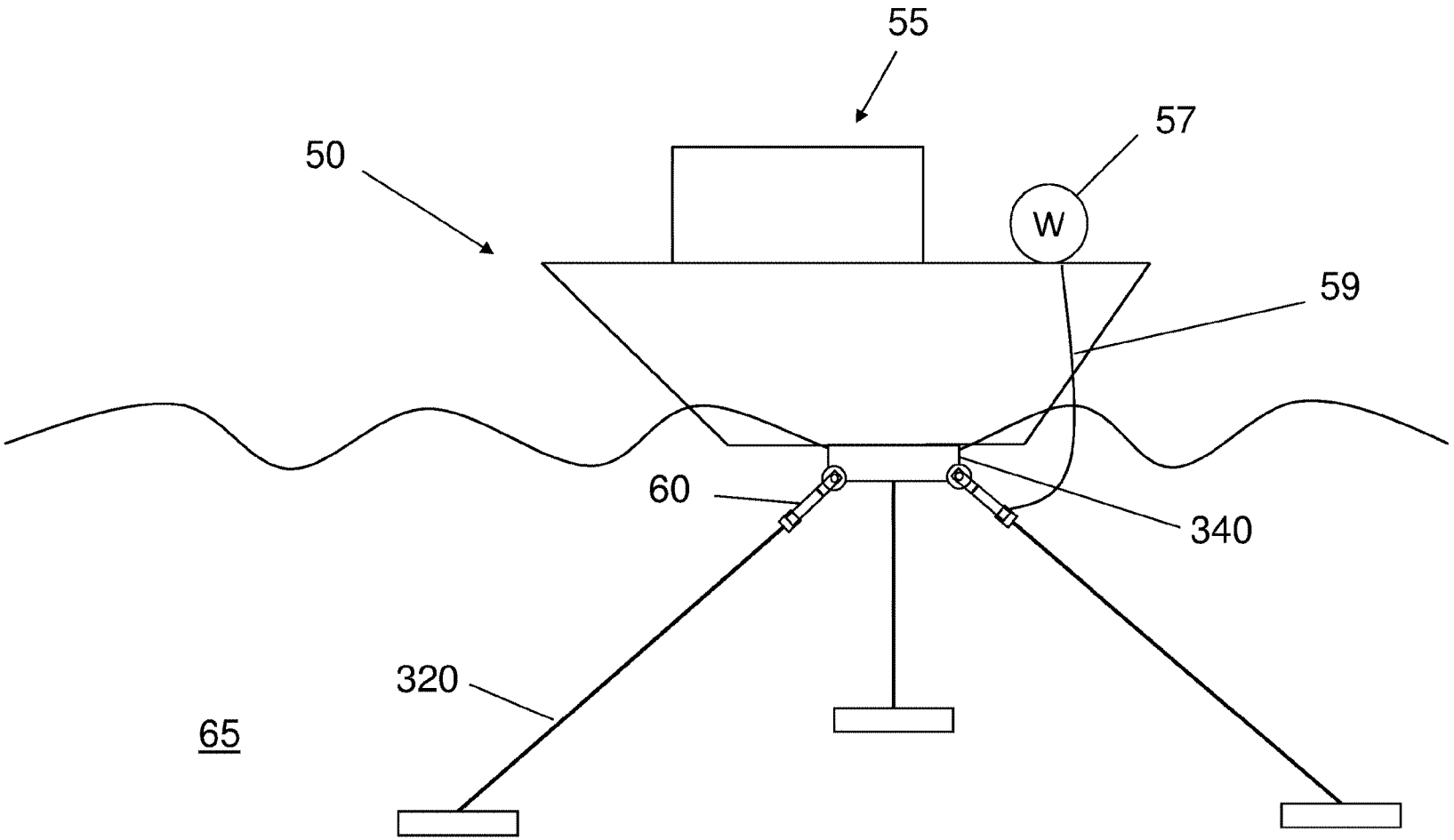
FIG. 2 a diagrammatic view of an apparatus for connecting a chain to a structure in accordance with an embodiment of the present invention.

Referring to FIG. 2, there is shown a system 50 for mooring, tethering or anchoring of a structure 55, generally designated 50, according to an embodiment of the present invention. Like features are denoted by like numeral but incremented by a 300.

The system 50 comprises at least one device 60, such as a chain stopper 60, for connecting the chain 320 to a structure 55. The system 50 comprises a structure 55, which can be an offshore structure, marine structure, subsea structure, vessel or the like. Here, the structure 55 is in the form of a vessel 55 comprising a chain table 340, which can be rotatably connected to the vessel 55, e.g. to allow the vessel 55 to move or rotate relative to the chain table 340. It will be appreciated that in other examples the structure may be a buoy, floating platform or structure, or a subsea structure or the like. The system 50 can comprise the chain 320, such as a mooring, tethering or anchoring chain. It will be appreciated that in other examples, the device 60 may connect a line or wire or the like to the vessel 55. The chain 320 comprises a plurality of chain links. As can be seen in FIG. 2, a distal end or portion of the chain 320 can be moored or anchored to a seabed 65. A proximal end or portion of the chain 320 is connected to the chain table 340 of the vessel 55 by the device 60.

The device 60 is suitable for adjusting a length and/or tension of the chain or line 320 relative to the structure 55 or a portion thereof, such as the chain table 340. In use, adjusting a length of the chain 320 and/or tensioning of the chain 320 can be achieved by pulling, such as pulling-in, pulling substantially upwards and/or towards the vessel 55, or letting out or releasing of the chain 320.

In this example, the vessel 55 comprise a winch means 57, such as winch, jack, tensioner or the like, configured for pulling or letting out of the chain 320, thereby adjusting or controlling a length of the chain 320 and/or tension of the chain 320. As shown in FIG. 2, the winch means 57 is in communication with the device 60 so as to allow pulling-in or letting-out of the chain 320 or a portion thereof. The winch means 57 can actuate, such as hydraulically or electrically actuate, the device 60 to allow pulling-in or letting-out of the chain 320 or a portion thereof. It will be appreciated that in other examples a control means or controller may be provided, which may be in communication with the device and/or may be configure to actuate the winch means 57 and/or device 60.

In the example of FIG. 2, the device 60 is connected to the winch means 57 via a cable, line, hydraulic and/or electrical line, umbilical 59 or the like, so as to allow actuation.

Figure 3:
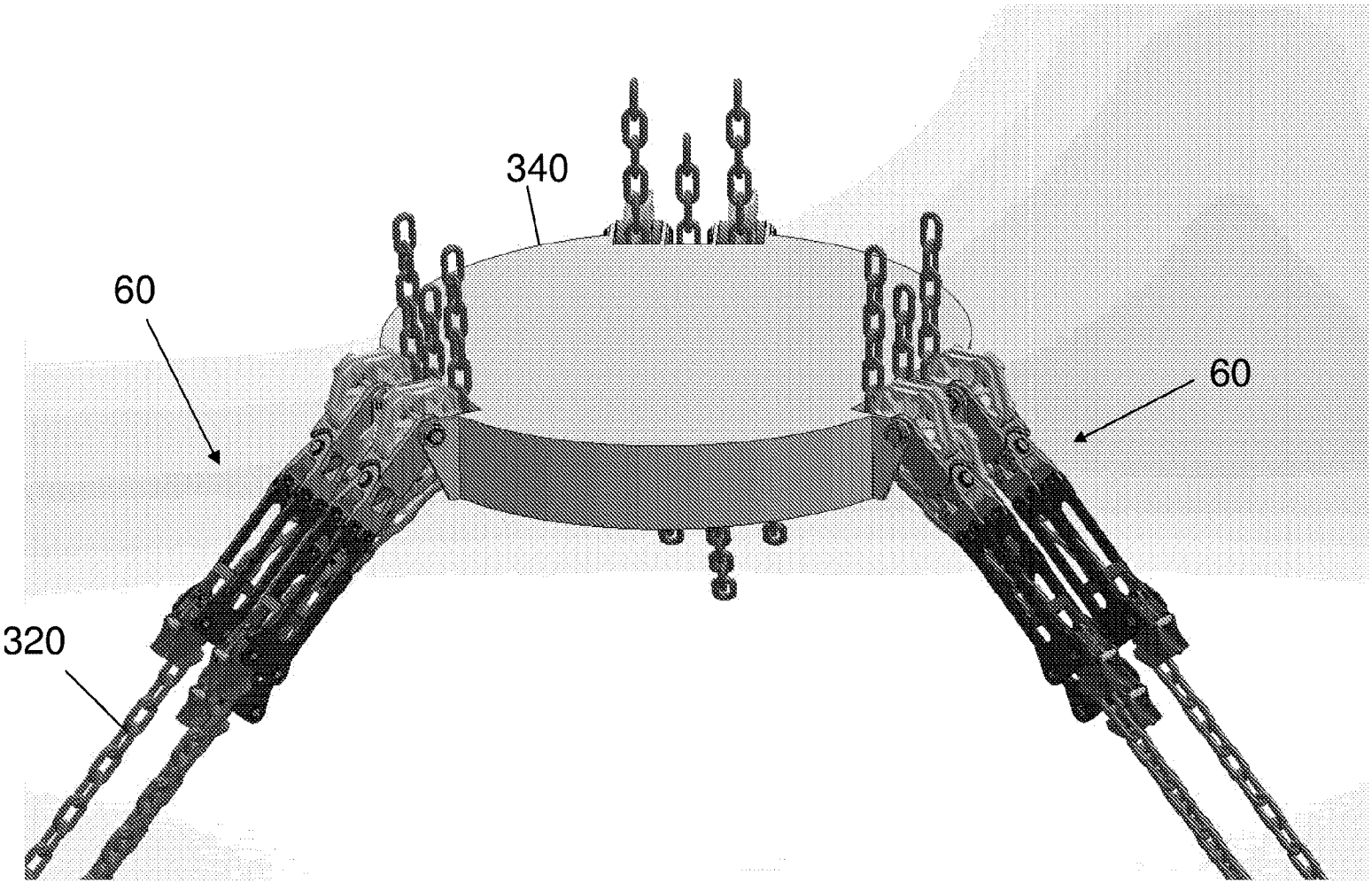
FIG. 3 a perspective representation of a chain table with six chain stoppers according to an embodiment of the present invention connected thereto.

Referring to FIG. 3, there is shown one or more device(s) 60, such as one or more chain stopper(s) 60, generally designated 60 according to an embodiment of the present invention. In this example, six devices 60 are arranged in three sets of two to connect the chain 320 to the chain table 340. It will be appreciated that in other examples, the arrangement of one or more devices 60 on the vessel 55 or chain table 340 may be varied. Alternatively or additionally the number of devices 60, connected to the chain table 340 or vessel 55 may be varied.

Figure 4:
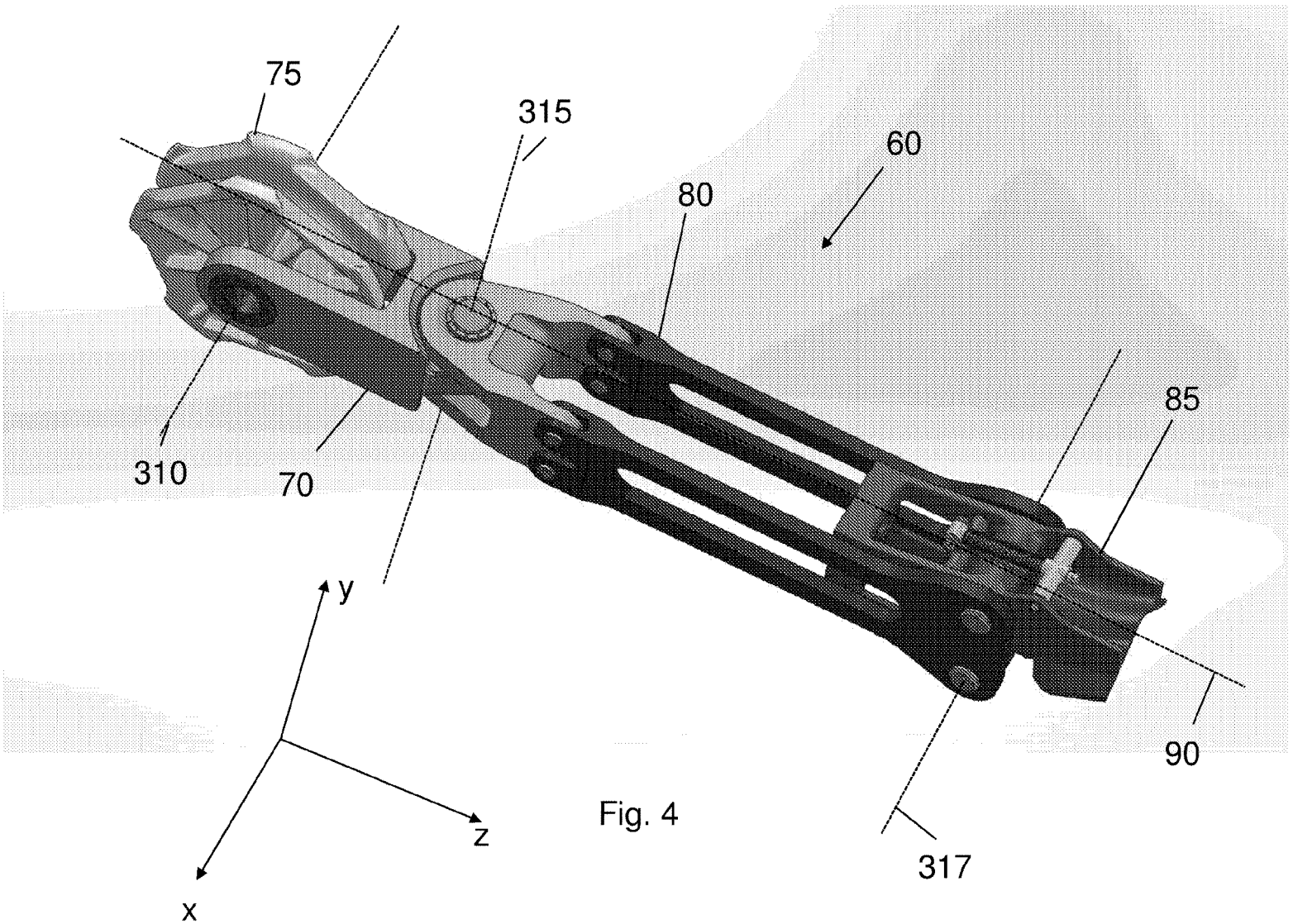
FIG. 4 a perspective representation of a chain stopper in accordance with an embodiment of the present invention.

As can be seen in FIG. 4, the device 60 comprises a first portion 70 configured to be pivotably or rotatably connected or connectable to a vessel 55 so as to provide pivotal or rotational movement of the first portion 70 relative to a vessel 55 about or around a first axis 310 of the first portion 70. The first portion 70 comprises a chain guiding means 75 arranged on or in the first portion 70 for rotational movement about or around the first axis 310 of the first portion 70. Here the chain guiding means is in the form of a guide wheel. It will be appreciated that in other examples, the chain guiding means may include a sheave, fairlead wheel or cog wheel.

The device 60 comprises a second portion 80, which is in this example, pivotably or rotabaly connected to the first portion 70 to provide pivotal or rotational movement of the second portion 80 relative to the first portion 70. The second portion is pivotably or rotatably movable relative to the first portion 70 about or around a second axis 315 of the second portion 80. The device 60 comprises at least one means 85 for engaging the chain 320, which is arranged on or in the second portion 80. The engaging means 85 are connected to the second portion 80 to allow pivotal or rotational movement of the engaging means 85 relative to the second portion 80. In this example, the connection between the engaging means 85 and the second portion 80 is configured to limit or restrict the range of rotational movement of the engaging means 85 relative to the second portion 80.

In some examples, the engaging means 85 are connected to the second portion 80 to be rotatable or pivotable around or about a third axis 317 of the engaging means 85 and/or second portion 80. Here, the connection between the engaging means 85 and the second portion 80 and/or the device 60 is configured to simultaneously provide pivotal and slideable movement of the engaging means 85 about the third axis 317. By allowing pivotal or rotational movement of the engaging means 85 relative to the first and/or second portion, adjusting of a length and/or tensioning of the chain may be simplified.

Referring to FIG. 4, the first axis 310 and/or third axis is arranged so as to be oriented substantially perpendicular to the second axis 315 or vice versa.

The device 60 is suitable for adjusting a length and/or tension of the chain 320 relative to the vessel 55. The device 60 can be configured to connect, or attach, e.g. releasably connect or attach, the chain 320 to a vessel 55.

The first axis 310 comprises a substantially transverse first axis 310. The first axis 310 is arranged to be substantially perpendicular to a longitudinal or central 90 axis of the first portion 70 and/or device 60.

The second axis 315 is a substantially transverse second axis 310. The second axis is arranged to be substantially perpendicular to the longitudinal axis 90 of the first portion 70, second portion 80 and/or device 60.

As can be seen in FIG. 4, the first axis 310 and/or third axis 317 can be considered as extending in an x-direction. The second axis 315 can be considered as extending in a y-direction. The longitudinal axis 90 can be considered as extending in a z-direction.

The guide wheel 75 is pivotably or rotatably arranged on or in the first portion 70 for movement, such as rotational moment, about the first axis 310 of the first portion 70.

Figure 5:
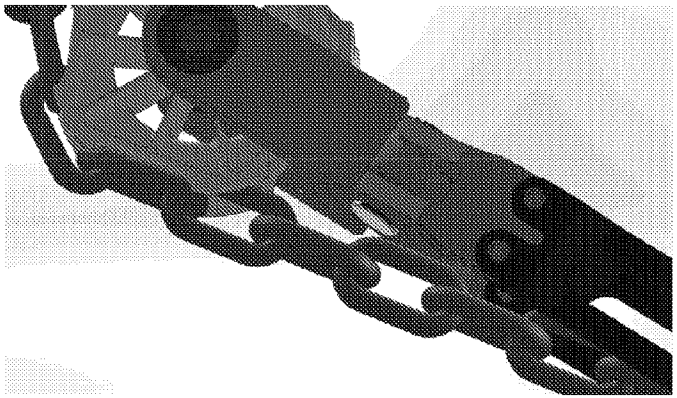
FIG. 5 (*a*) a side view of the chain stopper of FIG. 4 with a chain threaded therethrough.
Figure 5:
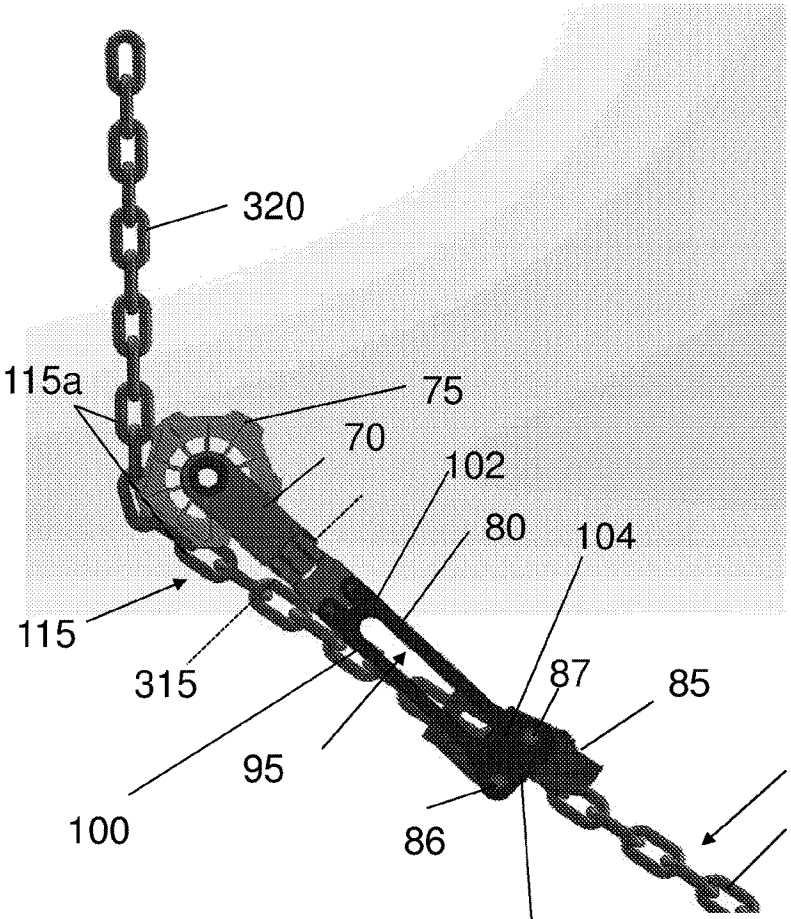

As can be seen in FIGS. 5 (*a*) and 5 (*b*), the second portion 80 comprises or defines a passage 95 through which the chain 320 can be run, threaded and/or pulled. In this example, the passage 95 is partially open so that the chain 320 contained therein is visible. By providing a partially open passage 95, the chain 320 may be visible, which may simplify inspection of the chain 320.

The second portion 80 comprises a first 100 and/or a second 105 opening for receiving the chain 320. The chain 320 exits or enters the second portion 80 at the first opening 100, which is arranged at or on the second portion 80, such as at a proximal end 102 of the second portion 80, as shown in FIG. 5 (*a*).

Alternatively or additionally the chain 320 exits or enters the second portion 80 at the second opening 105, which is arranged at or on the second portion 80, such as at a distal end 104 of the second portion 80.

Here, the means for engaging 85 of the chain 320 are arranged at the distal end 104 of the second portion 80. The engaging means 85 are configured to receive the chain 320. For example, the chain is pulled through, threaded through and/or directed through the engaging means 85. The engaging means 85 define or comprise the second opening 105 of the second portion 80.

In use, the chain 320 can have a slack or less tensioned portion 115 and a tensioned portion 110. In the example shown in FIG. 5(*a*), when no tension is applied at the proximal end 115*a* of the chain, the portion of chain 320 exiting or entering the first opening 100 of the second portion 80 may be slack or loose. Alternatively or additionally, when no tension is applied to the proximal end or portion 115*a* of the chain 320, the portion 110 of the chain 320 that enters the second opening 105 of the second portion 80, e.g. the distal end or portion 110*a*, may be tensed or be under tension, in use, due to the distal end or chain 110*a* being moored or anchored to the seabed 65.

As shown in FIGS. 5 (*a*), 6 and 7(*a*), the proximal end or portion 115*a* of the chain 320, which may be the less tensioned or slack portion 115, is disposed or arranged so as to pass below or under the first axis 310, second axis 315 and/or the guide wheel 75.

The proximal end or portion 115*a* of the chain 320 passes below or under the first axis 310, second axis 315 and/or guide wheel 75 so as to provide a clearance and/or space between the chain 320 and first 310 and/or second axis 315. By passing the proximal end or portion 115*a* of the chain 320 below or under the first axis 310, second axis 315 and/or guide wheel 75 to provide a clearance and/or space between the chain 320 and first 310 and/or second axis 315, catching of the chain 320 or a portion thereof on the first 310 and/or second axis 315 may be prevented. It will be appreciated that in examples where tension is applied to the proximal end or portion 115*a* of the chain 320, the proximal end or portion may also be disposed or arranged so as to pass below or under the first axis 310, second axis 315 and/or the guide wheel 75, as, for example shown in FIG. 7(*a*).

The guide wheel 75 guides the chain 320 about the first axis 310 offset or at distance 120 from the first axis 310. The offset or distance 120 can be defined between the first axis 310 and the chain engagement portion or point 125 of the guide wheel 75, e.g. a portion or point 125 of the guide wheel 75, which is in contact with the chain 320, as shown in FIG. 6.

Figure 6:
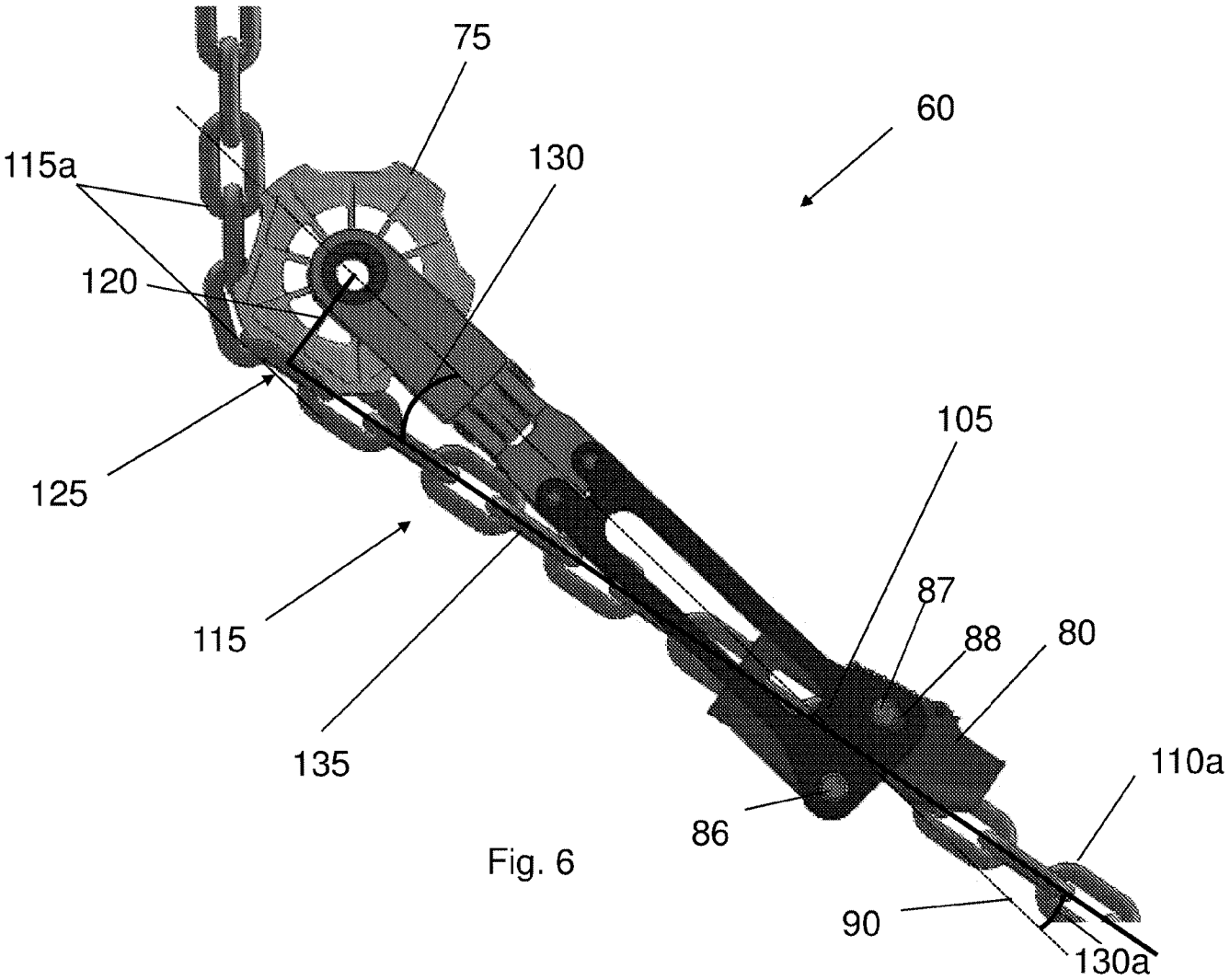
FIG. 6 a side view of the chain stopper of FIG. 5 (*a*) showing an acute angle between a less tensioned or slack portion of a chain and a longitudinal axis of the chain stopper.

Referring to FIG. 6, the proximal portion or end 115*a* of the chain 320, which may be the less tensioned or slack portion 115, e.g. when no tension is applied to the proximal end or region 115*a* of the chain 320, is disposed at an acute angle 130 to the longitudinal or central axis 90 of the device 60. As shown in FIG. 6, in use, in the first position of the engaging means 85, e.g. when no tension is applied to the proximal portion or end 115*a* of the chain 320, the proximal end or portion 115*a* of the chain 320 is in line with or coaxially arranged to the distal end or portion 110*a* of the chain 320.

Figure 7:
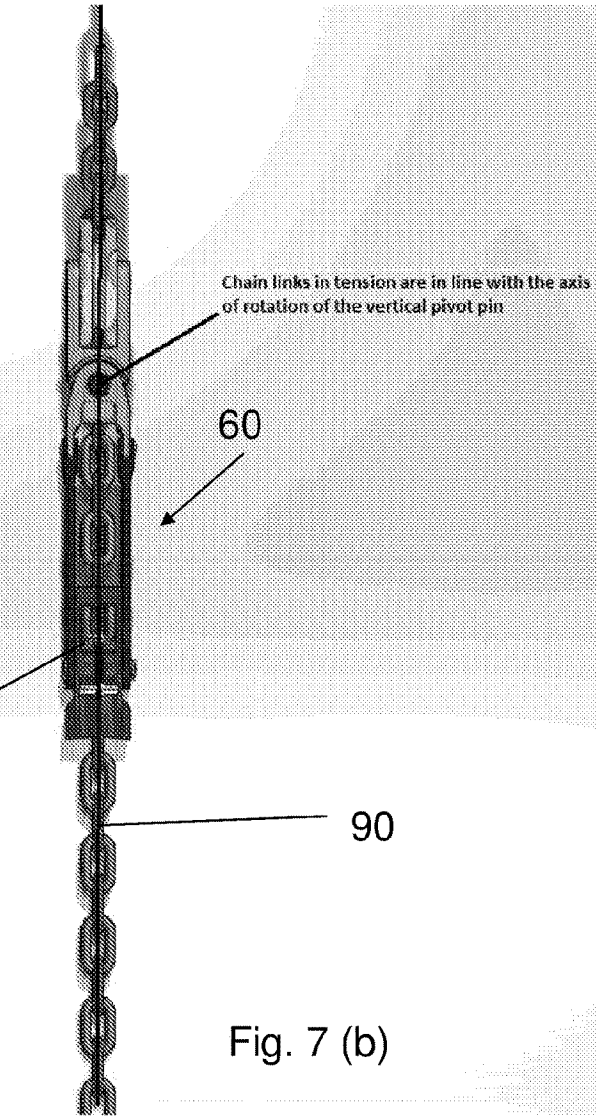
FIG. 7 (*a*) a side view of the chain stopper of FIG. 5 (*a*) showing a tensioned portion of a chain.
Figure 7:
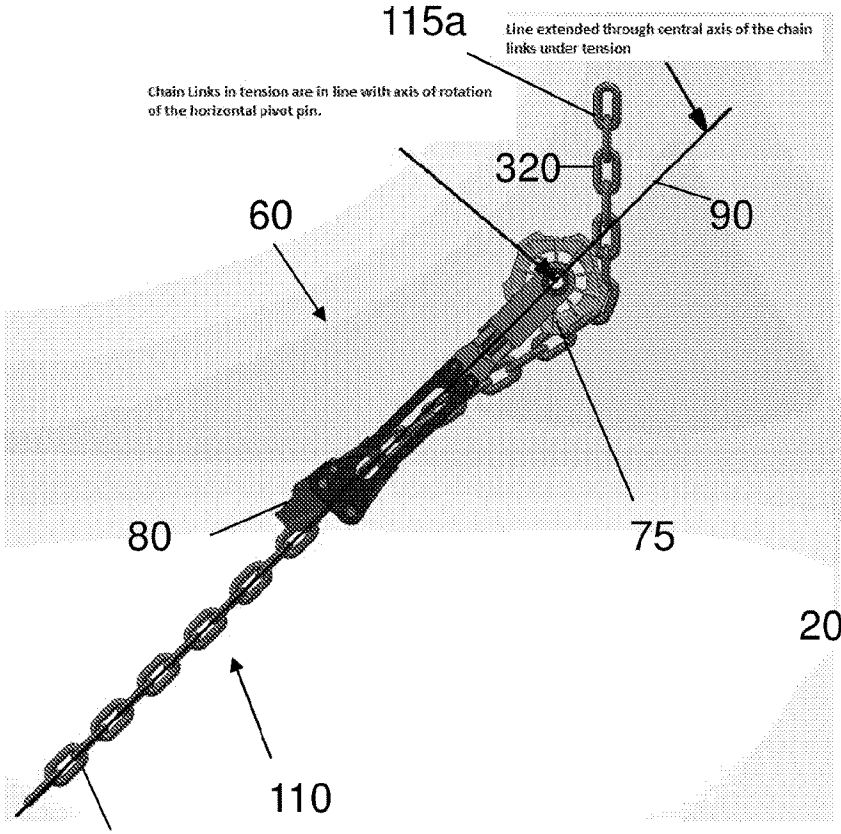

It will be appreciated that in other examples where tension is applied to the proximal end or region 115*a* of the chain 320, e.g. as shown in FIG. 7 (*a*), the proximal end or portion of the chain 320 may be under tension and may also extend at the acute angle 130 relative to the central axis 90 of the device. In other words, the proximal end or portion 115*a* of the chain 320 may extend tangentially from the guide wheel 75, as shown in the examples of FIGS. 5 (*a*) to 7 (*a*).

In the examples of FIGS. 5 (*a*) and 6, the proximal end or portion 115*a* of the chain 320 exits or enters the second portion 80 at an acute angle 130 to the central or longitudinal axis 90 of the device 60. The acute angle can be defined by the offset or distance 120 and a further distance 135, as shown in FIG. 6. The further distance 135 is a distance or length 135 between the chain engagement portion or point 125 of the guide wheel 75 and engaging means 85 and/or second opening 105.

As described above, the engaging means is rotatable or pivotable relative to the second portion. For example, the engaging means 85 is rotatable or pivotal relative to the second portion 80 between a first position or configuration and a second position or configuration. Tension acting on the proximal end or portion 115*a*, e.g. by pulling-in of the chain 320, and/or the distal portion or end 110*a* of the chain can actuate or operate the engaging means 85 from the first position to the second position, or vice versa. The engaging means 85 may be in the first position, when no tension is applied to the proximal portion or end 115*a* of the chain 320, in use, as shown in the example of FIGS. 5 (*a*) and 6. In the first position of the engaging means 85, the distal end or portion 110*a* of the chain 320 enters or exits the second opening 105 at an angle 130*a* relative to the central axis 90, as shown in FIG. 6. In use, when tension is applied to the proximal end or portion 115*a* of the chain 320, for example by pulling-in of the chain 320, the engaging means rotates into the second position, which is shown in FIGS. 7(*a*) and (*b*). As can be seen in FIGS. 7 (*a*) and 7 (*b*), in the second position of the engaging means 85, the distal end or portion 110*a* is in line with or coaxially arranged to the central axis 90 of the first portion 70, second portion 80 and/or device 60. By providing a coaxial arrangement between the central axis of the device 60, first 70 and/or second portion 80 relative to the distal portion or end 110*a* of the chain 320, when tension is applied to the proximal end or portion of the chain 320, out of the plane (axis) bending or strain of the chain 320 may be prevented or eliminated. The coaxial arrangement may also allow the use of higher forces during pulling-in of the chain 320.

In the examples, of FIGS. 7 (*a*) and 7 (*b*), the chain 320 extends in a direction of the central or longitudinal axis 90 of the device, which perpendicularly intersects the first and/or second axes 310, 315 of the device, e.g. when tension is applied to the proximal end or portion 115*a*.

Figure 8:
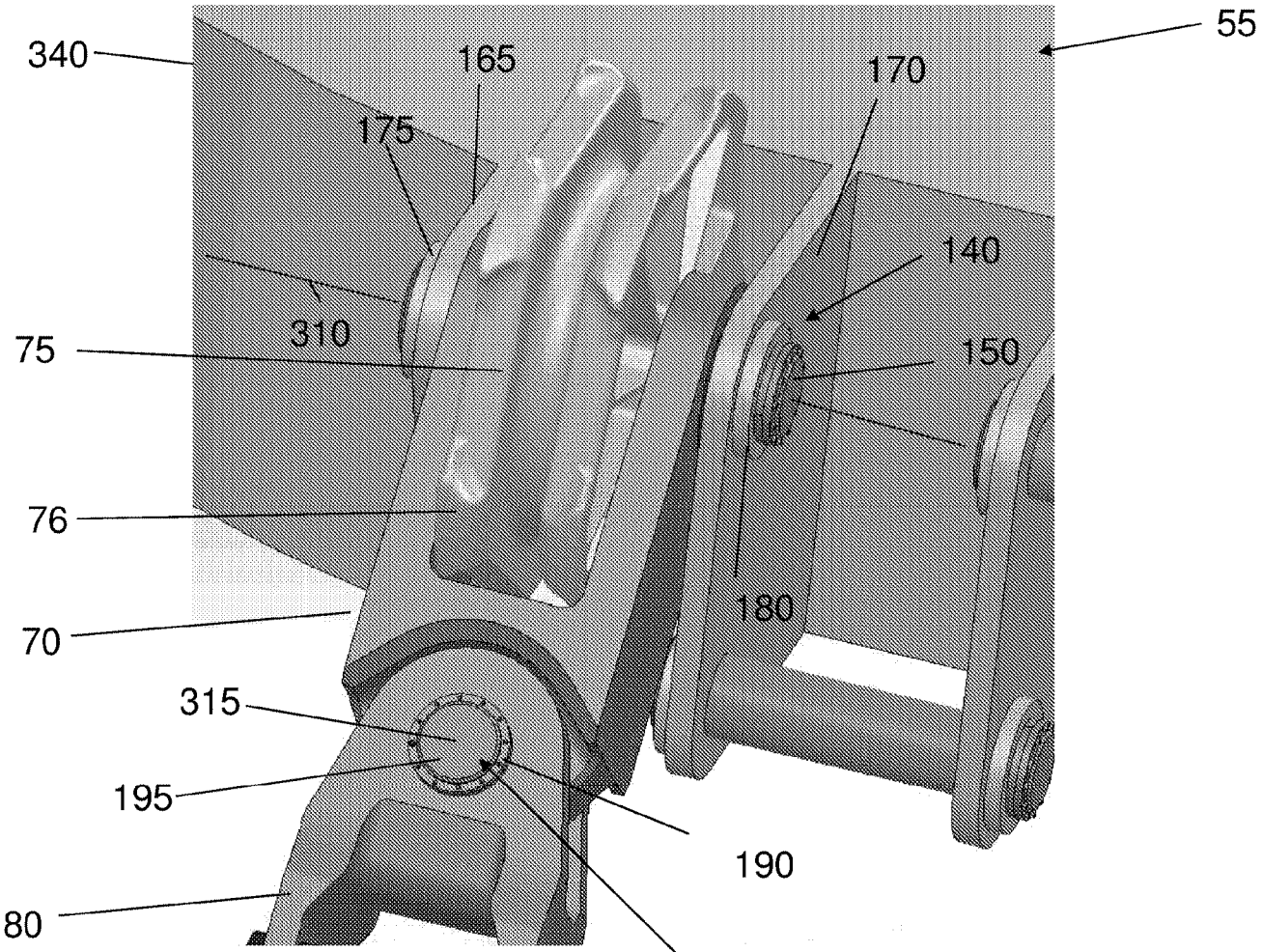
FIG. 8 a perspective view of an end of the chain stopper connected to a structure.

As shown in FIGS. 4 to 7 (*b*), the first axis 310 can be offset or spaced, such as offset or spaced along the longitudinal direction and/or longitudinal axis 90 of the device 60, from the second axis 315. For example, the first axis 310 can be provided at an end of the first portion 70 proximal to the vessel 55. The second axis 315 can be provided at a distal end of the first portion 70 and/or at an end of the second portion 80 proximal 102 to the first portion 70. Referring to FIG. 8, the first axis 310 defines or comprises a substantially horizontal axis 310. In other words, the first axis 310 may be provided in a horizontal plane, e.g. a substantially horizontal plane. By providing movement of the first portion 70 about the substantially horizontal axis 310 of the first portion 70, fabrication the device 60, apparatus or system 50 and/or attachment of the device 60 and/or first portion 70 to the vessel 55 may be simplified and/or weight of the device 60 or system 55 may be reduced.

The first axis 310 allows movement, such as rotational movement, of the first portion 70 relative to the vessel 55 and/or chain table 340 comprising at least one first degree of freedom. The second axis 315 allows movement, such as rotational movement, of the second portion 80 relative to the first portion 70 and/or a vessel 55 and/or chain table 340 comprising at least one second degree of freedom. The at least one first degree of freedom is substantially perpendicular to the at least second degree of freedom.

The first and second portions 70,80 of the device 60 and/or the first and second axes 310,315 allow movement, e.g. rotational movement, of the chain 320 relative to the vessel 55 comprising two or more degrees of freedom. By providing the device 60 with the first 310 and/or second axis 315, movement, e.g. rotational movement, of the chain 320 relative to a vessel 55 comprises two or more degrees of freedom. The first 70 and second 80 portions of the device 60 and/or the first 310 and second 315 axes allow movement, such as rotational movement, of the chain 320 relative to the vessel 55 in two or more directions and/or planes. The two planes and/or directions may be substantially perpendicular to one another.

In some examples, the device 60 can be configured to connect, or attach, such as releasably connect or attach, the chain 320 to the vessel 55.

The first portion 70 is attached or connected to a vessel 55 or chain table 340 via a first connection means 140. In this example, a proximal end of the first portion 70 is attached or connected to the vessel 55 via the first connection means 140. Here, the first connection means 140 provides rotational movement of the first portion 70 about the first axis 310. The first connection means 140 provides a connection, linkage or joint, which comprises at least one first degree of freedom.

The second portion 80 is attached or connected to the first portion 70 via a second connection means 145. In this example, the proximal end 102 of the second portion 80 is attached or connected to the distal end of the first portion 70 via the second connection means 145. The second connection means 145 can provide rotational movement of the second portion about the second axis 315. The second connection means 145 provides a further connection, linkage or joint, which comprise at least one second degree of freedom (for example FIG. 8).

The first 140 and/or second connection means 145 allow rotational movement of the chain 320 about the first 310 and/or second axis 315 (axes) of the first 70 and/or second portion 80 relative the vessel 55 and/or chain table 340. The first 140 and/or second connection 145 means provide movement, such as rotational movement, of the chain 320 in two or more planes and/or directions relative to the vessel 55 and/or chain table 340. By providing rotational movement of the chain 320 or line in two or more planes and/or direction, bending stresses, such as out of plane bending stresses, in the chain 320 may be minimised or prevented.

As can be seen in FIG. 8, the first connection means 140 comprise at least one first pin, protrusion or bolt 150.

Figure 9:
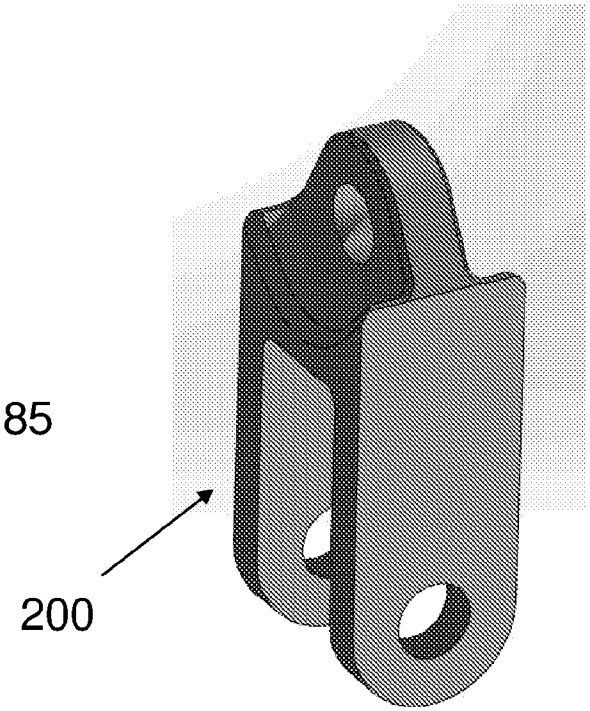
FIG. 9 (*a*) a perspective view of an connection arrangement of the chain stopper of FIG. 4.
Figure 9:
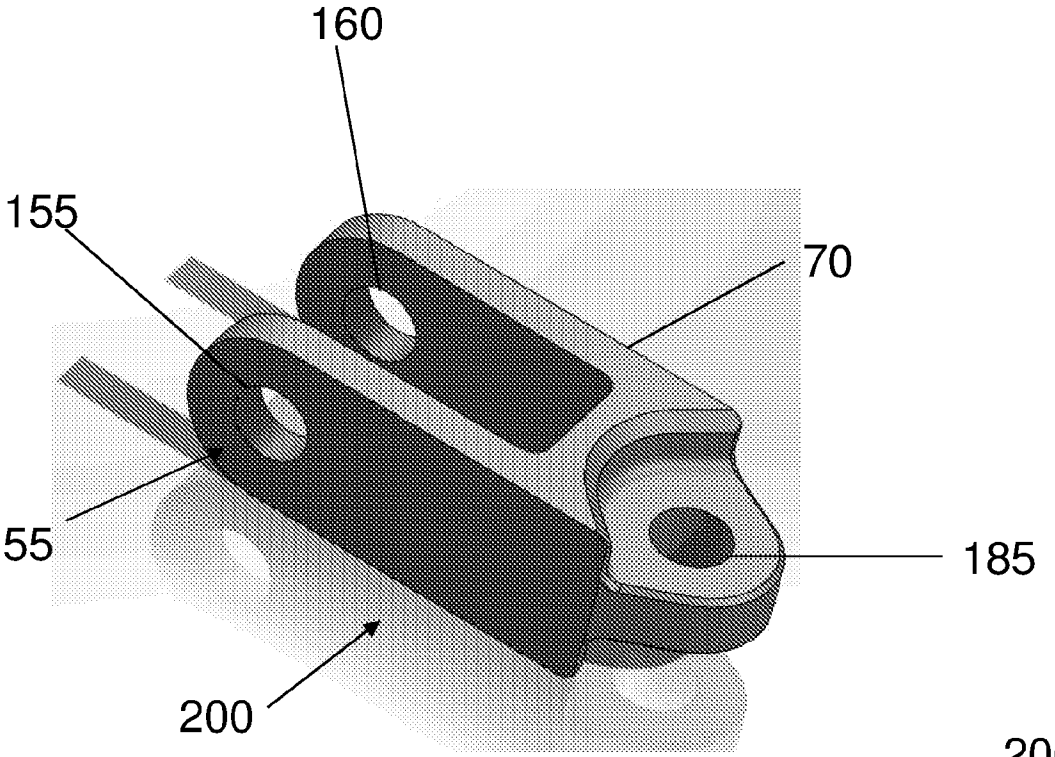

Referring to FIGS. 8, 9 (*a*) and 9 (*b*), the first connection means 140 comprise first 155 and second apertures 160 carried by or provided on the end, such as the proximal end, of the first portion 70 for attachment to a vessel 55 and/or chain table 340. The first 155 and second apertures 160 can be opposite or and/or opposed to one another.

In this example, the vessel 55 and/or chain table 340 comprises first 165 and second attachment means 170, which can extend or protrude from the vessel 55 and/or chain table 340, as shown in the example of FIG. 8. The first 165 and second attachment means 170 comprise first 175 and second further apertures 180, respectively. In use, the first 155 and second apertures 160 of the first portion 70 are be aligned with the first 175 and second further apertures 180 of the first 165 and second attachment means 170. When aligned the at least one first pin 150 extends through the first 155 and second apertures 160 of the first portion 70 and the first 175 and second further apertures 180 of the first 165 and second attachment means 170, thereby connecting the first portion 70 to a vessel 55 and/or chain table 340.

As can be seen in the examples of FIGS. 8, 9 (*a*) and 9 (*b*), the first 155 and/or second apertures 160 of the first portion 70 and/or the first 175 and/or second further apertures 180 of the first 165 and second attachment means 170 are arranged or oriented substantially vertically, such as in a substantially vertical plane and/or direction, relative to the vessel 55 and/or chain table 340. By vertically orienting the first 155 and second apertures 160 of the first portion 70 and/or the first 175 and second further apertures 180, axial or thrust loads, which may act on a vessel 55, chain table 340 and/or the device 60, for example during pulling or tensioning of the chain 320 or caused by a weight of the chain 320, may be reduced.

In this example, the second connection means 145 comprise a third aperture 185 carried by or provided on the end, such as the distal end, of the first portion 70, as shown in FIG. 9 (*a*). It will be appreciated that in other examples, the first portion 70 may comprise more than one aperture. The second connection means 145 comprise a fourth 190 and/or fifth aperture (not shown) carried on or provided by the end, such as the proximal end 102, of the second portion 80. The second connection means 145 comprise at least one second pin, protrusion or bolt 195, which extends through the third 185, fourth 190 and/or fifth apertures, thereby connecting the second portion 80 to the first portion 70.

The first 140 and/or second connection means 145 define or comprise a connection arrangement 200, such as uni-joint or extended uni-joint arrangement 200.

Here, the first 140 and/or second connection means 145 define or comprise at least one first bearing and/or second bearing, such as at least one first low friction bearing and/or second low friction bearing, such as an Orkot bearing or non-metallic bearing.

The first 310 and/or second transverse axis 315 (axes) can be provided or defined by the at least one respective first pin 150 and/or the at least one respective second pin 195, which may act as one or more bearing shaft(s) of the first and/or second bearing (s).

As can be seen in the example of FIG. 8, the guide wheel 75 and the first axis 310, e.g. the first pin 150, are coaxially arranged. The guide wheel 75 can be arranged to guide the chain 320 around the first transverse axis 310. By arranging the guide wheel 75 and the first transverse axis 310 coaxially, loads and/or moments caused by, e.g. pulling or tensioning of the chain 320, and which may act on the device 60, may be reduced. A coaxial arrangement of the guide wheel 75 and the first transverse axis 310 may reduce or prevent movement of the chain 320 and/or device 60, e.g. first 70 and/or second portions 80, in a substantially vertical plane and/or direction during pulling and/or tensioning of the chain 320 relative to a vessel 55 and/or chain table. The guide wheel 75 is arranged so as to facilitate pulling (pulling-in) of the chain 320, e.g. for adjusting a length of the chain 320, tension of the chain 320 and/or changing the position of the vessel 55, in use. The guide wheel 75 comprises or defines one or more pockets, cogs or protrusions 76 for engaging with the chain 320. In this example, the guide wheel 75 comprises or defines five pockets, cogs or protrusions 76. It will be appreciated that in other example, the guide wheel 75 may comprise more or less than five pockets, cogs or protrusions. A radius of guide wheel 75 defines offset or distance 120, shown in the example of FIG. 6.

Figure 10:
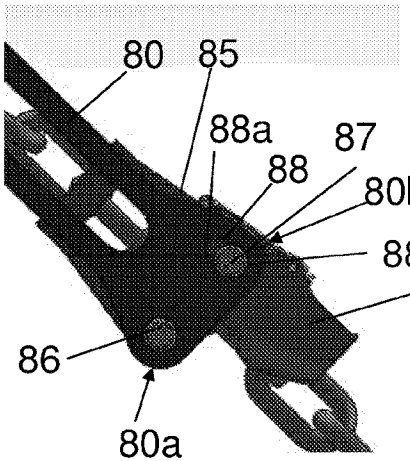
FIG. 10 (*a*) a side view of an engagement means of the chain stopper of FIG. 4 with a chain threaded therethrough.
Figure 10:
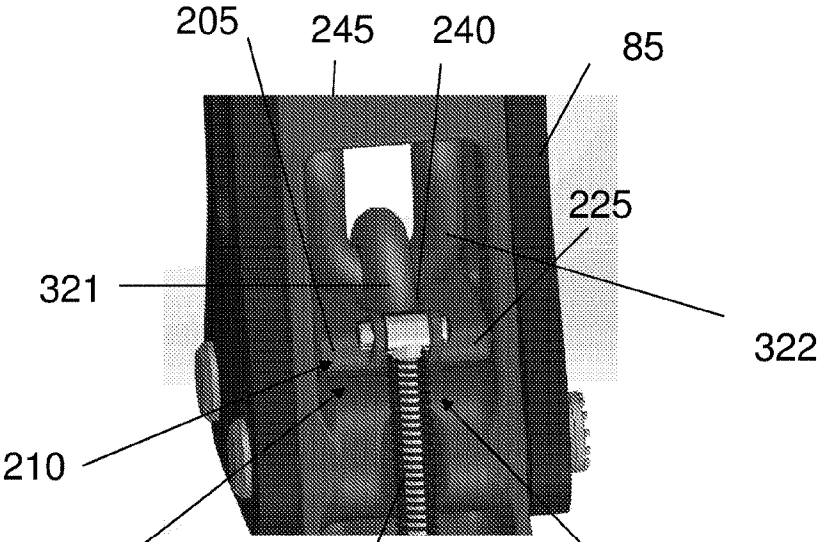
Figure 10:
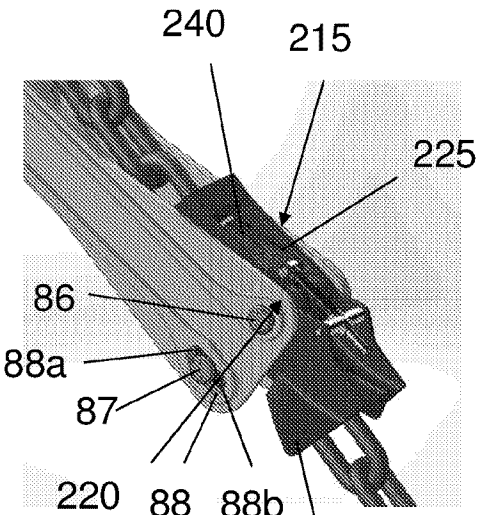
Figure 10:
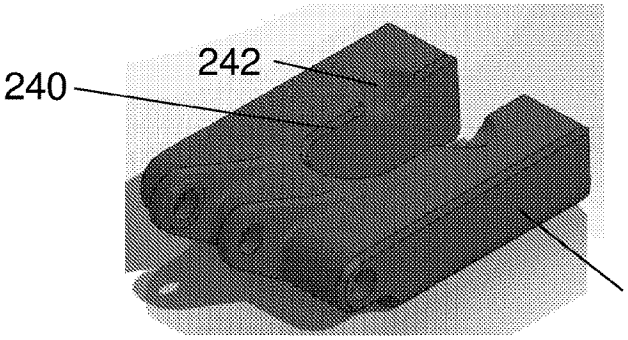

FIGS. 10(*a*) to 10(*c*) show an example of the engaging means 85. In the example of FIG. 10(*a*) the engaging means 85 are shown in the first position, whereas in the example of FIG. 10 (*c*), the engaging means are shown in a position between the first and second positions of the engaging means 85.

As described above, the connection between the engaging means 85 and the second portion 80 and/or device 60 is be configured to limit or restrict the range of rotational movement of the engaging means 85 relative to the second portion 80 and/or device 60. As shown in the example of FIGS. 10(*a*) to 10 (*c*), the engaging means 85 are pivotably connected to the second portion 80 at a first connection point or region 80*a* of the second portion 80 and slideably connected to the second portion 80 at a second point or region 80*b* of the second portion 80. As can be seen in FIGS. 10(*a*) to 10(*c*), the first point or region 80*a* can be arranged opposite the second point or region 80, such as width wise opposite.

An elongate member 86 in the form of a further pin, bolt or the like provides a pivotal connection between the engaging means and the second portion at the first point or region 80*a* of the second portion. The further pin 86 defines the third axis 317 of the engaging means 85.

A yet further elongate member 87 in the form of a yet further pin, bolt or the like extends through a pair of elongated slots 88 (one of the pair of slots is shown in FIGS. 10 (*a*) and 10 (*c*)) provided in the second portion 80, thereby slideably connecting the engaging means 85 to the second point or region 80*b* of the second portion 80.

In the example shown in FIG. 10 (*a*) the engaging means are in the second position, in which the yet further pin 87 abuts a second end 88*b* of the slot 88. When no tension is applied to the proximal end or region 115*a* of the chain 320, the engaging means may be in the first position, in which the yet further pin 87 abuts a first end 88*a* of the slot 88, as shown in the example of FIG. 5 (*a*). Alternatively, when no tensions is applied or the tension on the proximal portion or end 115*a* of the chain 320 increases, the engaging means may be in a position between the first and second positions, e.g. the yet further pin may be in a position between the first and second ends 88*a*, 88*b* of the slot 88, as shown in FIG. 10 (*c*).

Referring to FIGS. 10 (*a*) and 10 (*b*), the engaging means 85 define or comprise means 205 for adjusting of a length and/or tension of the chain 320, which may be connected or attached to the vessel 55 and/or chain table 340 by the device 60, as described above. In some examples, a position, such as an offshore position, of the vessel 55 can be altered and/or controlled by adjusting a length and/or tension of the chain 320 with respect to seabed 65 and/or the vessel 55.

The engaging means 85 can be configured to inhibit movement, such as movement in the longitudinal or axial direction 90 of the chain 320 and/or the device 90. For example, the engaging means 85 may be configured to restrain and/or lock any movement of the chain 320 in a first direction relative to the vessel 55, e.g. movement of the chain 320 in the direction of the longitudinal axis 90 of the device 60 towards a seabed 65. Alternatively or additionally, the engaging means 85 may be configured to allow movement of the chain 320 in a second direction relative to the vessel 55 and/or chain table 340, e.g. movement of the chain 320 in the direction of the longitudinal axis 90 of the device 60 towards the vessel 55 and/or chain table 340. In other words, the engaging means 85 may be configured to act as a ratchet or one-way ratchet, as will be described below.

Referring to FIGS. 10 (*a*) and 10 (*b*), the engaging means 85 are pivotably or rotatably arranged on or in the second portion 80 to allow movement, such as rotational movement, of the engaging means 85 with respect to the first 70 and/or second portion 80. By providing the engaging means 85 on a/the distal end 102 of the second portion 80 and/or allowing rotational or pivotal movement of the engaging means 85 relative to the first 70 and/or second portion 80, adjusting of a length and/or tension of the chain 320 may be simplified.

The engaging means 85 comprise an engaged 210 and/or a disengaged 215 configuration or position, as shown in the examples of FIGS. 10 (*b*) and 10 (*c*), respectively. In the engaged configuration 210, the engaging means inhibit movement of the chain 320 in one or more directions, such as along axial or longitudinal axis or direction 90 of first portion 70, second portion 90 and/or device 60. For example, in the engaged configuration the engaging means 85 restrain and/or lock (axial and/or longitudinal) movement of the chain 320 in the first direction (e.g. towards a seabed 65) relative to the first portion 70, second portion 80 and/or device 60.

In the disengaged configuration 315, the engaging means 85 allow movement of the chain 320 in one or more directions. For example, movement of the chain 320 is possible in the first and/or a second direction (e.g. towards the vessel 55 and/or the seabed 65). The engaging means 85 define or act as a ratchet 220, e.g. a one-way ratchet. By providing the second portion 80 with a ratchet 220 in the disengaged position 215, a length of the chain 320 and/or tension of the chain 320 may be adjusted and/or controlled. Alternatively or additionally, a position, such as an offshore position, of the vessel 55 may be altered and/or controlled by adjusting a length and/or tension of the chain 320.

Pulling, e.g. pulling-in or pulling substantially vertically upwards, of the chain 320 in the second direction (e.g. towards a vessel 55) actuates the engaging means 85 from the engaged 210 configuration into the disengaged configuration 215. Pulling, strain and/or tension acting in the first direction (e.g. towards a seabed) can actuate the engaging means 85 from the disengaged configuration into the engaged configuration. Alternatively or additionally, the engaging means 85 and/or device 60 is actuated, such as hydraulically or electrically actuated, from the engaged configuration 210 to the disengaged configuration 215, or vice versa. For example, the winch means 57 may be in communication with the engaging means 85 and/or device 60. The winch means 57 actuates, hydraulically or electrically actuates, the engaging means 85 from the engaged 210 to the disengaged configuration 215, or vice versa.

In some examples, the engaging means 85 can be connected to the winch means and/or the control means (not shown) via a cable, line, hydraulic and/or electrical line, umbilical 59 or the like, so as to allow actuation of the engaging means 85.

In use, the chain 320 is let out or released by actuating the engaging means 85 from the engaged configuration 210 to the disengaged configuration 215, e.g. by pulling of the chain 320 in the second direction or using an actuating means (not shown), and maintaining the engaging means 85 in the disengaged configuration 215, for example using the winch means, control means and/or a Remotely Operated Vehicle (ROV), while the chain 320 is let out or released.

In use, the chain 320 can be removed, maintained and/or exchanged from the engaging means 85 by actuating the engaging means into the disengaged configuration 215 using, for example a Remotely Operated Vehicle (ROV).

The engaging means 85 comprise or define a stopper member 225 mounted, e.g. pivotally mounted, so as to be actuateable between the engaged 210 and disengaged configuration 215 of the engaging means 85. The stopper member 225 is connected or fixed to the engaging means 85 via a hinged arrangement 230. The hinged arrangement 230 comprises a resilient member 235, such as a spring, which actuates the stopper member 225 in either the engaged 210 or disengaged configuration 215. In the engaged configuration 210 the stopper member 225 partially occludes the passage 95 of the second portion 80. The stopper member 225 comprises a slot or recess 240 for engaging with the chain 320 so as to prohibit movement of the chain 320 in the first direction. For example, the slot can be configured to allow passage of one or more chain links 321 of the chain 320, which are in alignment with the slot 340. The slot 240 can prevent passage of one or more chain links 322, which are in misalignment with the slot 240, shown in FIG. 10 (*b*).

One or more aligned chain links 321 are in a substantially parallel orientation relative to the slot 240. One or more misaligned chain links 322 are in a substantially perpendicular orientation relative to the slot 240. The chain may comprise a plurality and/or sequence of chain links 321,322, which are in alignment and/or misalignment with the slot 240. The slot or recess 240 of the stopper member 225 is arranged so as to provide a resolution of one or more chain links, e.g. a single and/or dual chain link resolution. The resolution of the stopper 225 member can be controlled by the shape of the slot or recess 240. For example, the shape of the slot 240 complements or matches a shape or profile of one or more aligned chain links to allow passage of one or more chain link. In some examples, the slot 240 comprises or defines a shape, such as a U-shape or the like, as shown in FIG. 10 (*d*). Alternatively or additionally, the stopper member 225 comprises a seat or support member 242 that is arranged on an edge or periphery of the slot or recess 240 (FIG. 10 (*d*)). In some example, the seat, support or guide can be spherical. In other example, the seat, support or guide can be oval, elliptical or the like.

One or more misaligned chain links 322 or an end thereof are supported by or rest against the seat or support member 242, in use. The shape of the seat or support member 242 matches or complements a shape or profile of one or more misaligned chain links 242.

In some examples, the second portion 80 may comprise one or more engaging means 85, as shown in FIG. 3. By providing the device 60 with one or more engaging means 85, such as two engaging means 85, single chain link resolution may be achieved. The one or more engaging means 85 are pivotably or rotatably mounted or arranged on or in the second portion 85. The one or more engaging means 85 are aligned along the longitudinal axis of the second portion 80 and/or the device 60.

In some examples, the one or more engaging means 85 can be spaced from another along the longitudinal axis 90 of the second portion 80 and/or device 90. Alternatively or additionally, the one or more engaging means 85 can be arranged adjacent to another along the longitudinal axis 90 of the second portion 80 and/or device 60.

Figure 11:
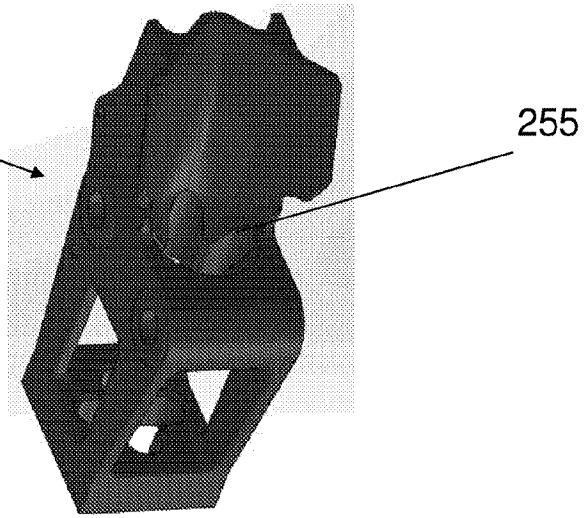
FIG. 11 (*a*) a perspective view of a guiding portion of the engagement means of FIG. 10 (*a*)
Figure 11:
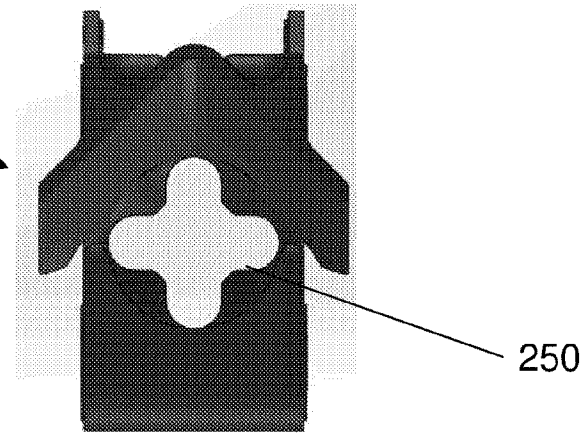
Figure 11:
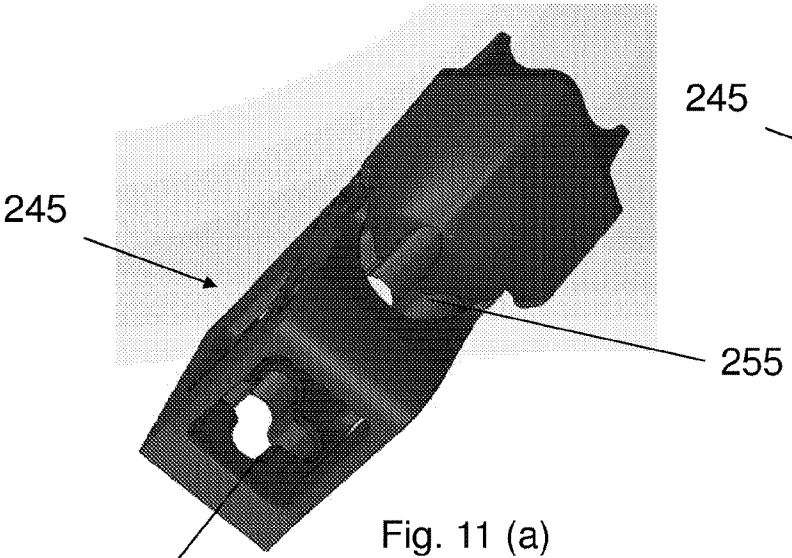
Figure 11:
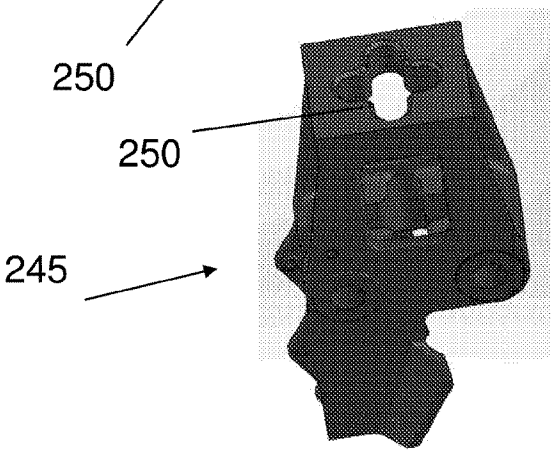

Referring to FIGS. 11 (*a*) to 11 (*d*), the engaging means 85 comprise or define at least one guiding portion 245. The guiding portion 245 is configured to maintain and/or cause an orientation of the chain 320 while being run, threaded and/or pulled through the engaging means 85 and/or second portion 80. The guiding portion 245 comprises a first guiding aperture 250, which is positioned or located on a first end of the guiding portion 245 and/or engaging means 85. The guiding portion 245 comprises a second guiding aperture 255, which is positioned or located on a second end of the guiding portion. The first guiding aperture 250 is arranged opposite of the second guiding aperture 255. The first and second guiding apertures 250,255 comprise or define a shape or profile for ensuring the orientation of the chain 320. For example, the first and second guiding apertures 250, 255 can comprise or define a cruciform, clover leaf shape or the like.

It should be understood that the embodiments described herein are merely exemplary and that various modifications may be made thereto without departing from the scope of the invention.

For example, a structure may be an offshore structure, marine structure, platform, floating platform or a buoy or the like.

For example, the guiding means may comprise or define a bending shoe.

In the embodiments described hereinbefore, the chain may be a chain, line, wire, rope or the like.

For example, the first and second axes may coincide.

The device and/or engaging means may be in communication with a control means, which may be located on a structure or an onshore site. The control means may be a controller, controlling station, room or the like.

The winch means may comprise the control means.

The device and/or engaging means may be in wireless communication with the control means and/or winch means.

For example, the engaging means and/or device may comprise an actuating means for actuating the engaging means from the engaged configuration to the disengaged configuration, or vice versa. The actuating means may be a cylinder, piston or the like, e.g. a hydraulic cylinder or piston.

The actuating means may be integral with the device and/or engaging means.

A ROV may be used to actuate the engaging means from the engaged configuration to the disengaged configuration, or vice versa.

The device, apparatus and associated methods of the present invention may provide a means for connecting a chain to a structure and/or adjusting a length or tension of a chain connected to a structure.

The device and apparatus of the present invention may comprise a substantially horizontal axis. By providing movement of a first portion of the device about the substantially horizontal axis of the first portion, fabrication of the device and/or apparatus and/or attachment of the device and/or first portion to a structure may be simplified and/or weight of the apparatus may be reduced.

The device, apparatus or system and associated methods of the present invention may provide a first and/or second connection a means, which may allow rotational movement of a chain in two or more planes and/or directions relative to a structure. By providing rotational movement of the chain or line in two or more planes and/or direction, bending stresses, such as out of plane bending stresses, in the chain or line may be minimised or prevented.

The device, apparatus or system and associated methods of the present invention may provide a vertically orientation of the first and/or second apertures of a first portion and/or the first 90 and/or second further apertures of a first and second attachment means relative to a structure. By vertically orienting the first and second apertures of the first portion and/or the first and second further apertures, axial or thrust loads, which may act on a structure and/or the apparatus, for example during pulling or tensioning of a chain or caused by a weight of a chain, may be reduced.

The device, apparatus or system and associated methods of the present invention may guide a chain around the first transverse axis. By arranging the guiding means and the first transverse axis coaxially, loads and/or moments caused by, e.g. pulling or tensioning of a chain, and which may act on the apparatus, may be reduced. A coaxial arrangement of the guiding means and the first transverse axis may reduce or prevent movement of a chain and/or device, e.g. first and/or second portions, in a substantially vertical plane and/or direction during pulling and/or tensioning of a chain relative to a structure. The device, apparatus or system and associated methods of the present invention may provide a passage, which may be partially open so that a chain contained therein is visible. By providing a partially open passage, a chain may be visible in use, which may simplify inspection of a chain.

The device, apparatus or system and associated methods of the present invention may provide a clearance and/or space between a chain and a connection arrangement. By arranging the first opening to provide clearance or space between the connection arrangement and the chain, catching of the chain on the connection arrangement may be prevented, in use.

The invention claimed is:

1. A device for connecting a chain line, a mooring, tethering, or anchoring chain, to a structure, the device comprising:

a first portion pivotably or rotatably connected to the structure so as to provide movement of the first portion relative to the structure about or around a first axis of the first portion;

wherein the first portion comprises a chain or line guide arranged for rotational spin movement about or around the first axis of the first portion; and a second portion rotatably connected to the first portion so as to provide movement of the second portion relative to the first portion about or around a second axis of the second portion.

2. A device as claimed in claim 1, wherein the chain or line guide comprises a wheel, and the first axis passes transversely through a center of the chain or line guide.

3. A device as claimed in claim 1, wherein the device comprises at least one engaging portion for a chain or line, the engaging portion being pivotably or rotatably connected to the device and/or the second portion of the device.

4. A device as claimed in claim 1, wherein the chain guide is arranged on or in the first portion.

5. A device as claimed in claim 2, wherein the first axis is oriented substantially perpendicular to the second axis or vice versa.

6. A device as claimed in claim 1, wherein the first axis comprises a substantially transverse first axis, and the first axis is substantially perpendicular to a longitudinal axis or central axis of the first portion and/or device.

7. A device as claimed in claim 2, wherein the second axis is a substantially transverse second axis, and the second axis is substantially perpendicular to a longitudinal axis or central axis of the first portion, second portion and/or device.

8. A device as claimed in claim 1, wherein the first axis is considered as extending in an x-direction, the second axis is considered as extending in a y-direction, and the longitudinal axis is considered as extending in a z-direction, and wherein the first axis is substantially horizontal.

9. A device as claimed in claim 2, wherein the second portion comprises or defines a passage through which a chain or a portion thereof may be run, threaded and/or pulled, and wherein the passage is partially open so that a chain contained therein is visible.

10. A device as claimed in claim 2, wherein the second portion comprises a first and/or a second opening for receiving a chain, and wherein the chain exits or enters the second portion at the first opening, which is arranged at or on the second portion and/or the chain exits or enters the second portion at the second opening, which is arranged at or on the second portion.

11. A device as claimed in claim 3, wherein the engaging portion is arranged at the distal end of the second portion, is configured to receive a chain pulled therethrough, threaded therethrough and or directed therethrough, and/or is rotatable or pivotal relative to the second portion and/or device between a first position or configuration and a second position or configuration.

12. A device as claimed in claim 1, wherein the chain guide is configured to guide a chain about the first axis offset or at distance from the first axis, the first axis being provided at an end of the first portion proximal to the structure.

13. A device as claimed in claim 1, wherein the device is configured such that a proximal portion of a chain is disposed or extends at an acute angle to a longitudinal or central axis of the device.

14. A device as claimed in claim 2, wherein the first axis is offset or spaced from the second axis or vice versa.

15. A device as claimed in claim 2, wherein the second axis is provided at the distal end of the first portion and/or at an end of the second proximal to the first portion.

16. A device as claimed in claim 2, wherein the first axis allows movement of the first portion relative to a structure comprising at least one first degree of freedom, and wherein the second axis allows movement of the second portion relative to the first portion and/or the structure comprising at least one second degree of freedom.

17. A device as claimed in claim 2, wherein the first and second portions of the device and/or the first and second axes allow movement of a chain relative to the structure in two or more directions and/or planes, and wherein the at least two of the two or more directions and/or planes are substantially perpendicular to another.

18. A system comprising:

a structure; and at least one device according to claim 1 for connecting a chain to the structure.

19. A method for mooring, tethering or anchoring a structure relative to a seabed, the method comprising:

providing a device as claimed in claim 1; and running or threading a chain through the device.

20. A method as claimed in claim 19, wherein the method further comprises adjusting a length and/or tension of the chain by pulling of the chain to a desired or pre-determined length and/or tension.

21. A system as claimed in claim 18, wherein the structure is selected from one of: a marine structure, an offshore structure, a floating structure, a floating platform, a buoy, or a vessel.

* * * * *